US007041721B2

(12) United States Patent
Rajagopalan et al.

(10) Patent No.: US 7,041,721 B2
(45) Date of Patent: May 9, 2006

(54) HIGHLY NEUTRALIZED POLYMER GOLF BALL COMPOSITIONS INCLUDING OXA ACIDS AND METHODS OF MAKING SAME

(75) Inventors: Murali Rajagopalan, South Dartmouth, MA (US); Kevin M. Harris, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 138 days.

(21) Appl. No.: 10/438,072

(22) Filed: May 15, 2003

(65) Prior Publication Data

US 2003/0225197 A1 Dec. 4, 2003

Related U.S. Application Data

(60) Continuation-in-part of application No. 10/067,887, filed on Feb. 8, 2002, now Pat. No. 6,844,684, and a continuation-in-part of application No. 09/759,329, filed on Jan. 16, 2001, now Pat. No. 6,586,511, which is a continuation-in-part of application No. 09/608,566, filed on Jun. 30, 2000, now Pat. No. 6,391,955, and a continuation-in-part of application No. 09/225,341, filed on Jan. 5, 1999, now Pat. No. 6,084,016, which is a continuation-in-part of application No. 09/215,370, filed on Dec. 18, 1998, now Pat. No. 6,121,384, which is a continuation of application No. 09/132,193, filed on Aug. 10, 1998, now Pat. No. 6,255,361, which is a division of application No. 08/978,510, filed on Nov. 25, 1997, now Pat. No. 5,869,578, which is a continuation of application No. 08/828,636, filed on Mar. 31, 1997, now Pat. No. 5,856,388, which is a continuation of application No. 08/560,763, filed on Nov. 21, 1995, now abandoned, which is a continuation-in-part of application No. 08/482,520, filed on Jun. 7, 1995, now Pat. No. 5,616,640.

(51) Int. Cl.
*A63B 37/12* (2006.01)

(52) U.S. Cl. ..... 524/308; 524/317; 524/320; 524/368; 473/372; 473/373; 473/385

(58) Field of Classification Search ..... 524/308, 524/317, 320, 368; 473/372, 373, 385
See application file for complete search history.

(56) References Cited

U.S. PATENT DOCUMENTS

| | | | | |
|---|---|---|---|---|
| 2,183,853 | A | 12/1939 | Haussmann | 260/404 |
| 3,264,272 | A | 8/1966 | Rees | 260/78.5 |
| 3,472,825 | A | 10/1969 | Walter et al. | 260/88.1 |
| 3,819,768 | A | 6/1974 | Molitor | 260/897 B |
| 3,926,891 | A | 12/1975 | Gross et al. | 260/29.6 E |
| 3,970,626 | A | 7/1976 | Hurst et al. | 260/29.6 WB |
| 4,274,637 | A | 6/1981 | Molitor | 273/235 R |
| 4,295,652 | A | 10/1981 | Saito et al. | 273/235 R |
| 4,323,247 | A | 4/1982 | Keches et al. | 273/235 R |
| 4,431,193 | A | 2/1984 | Nesbitt | 273/235 R |
| 4,473,665 | A | 9/1984 | Martini-Vvedensky et al. | 521/79 |
| 4,508,309 | A | 4/1985 | Brown | 249/81 |
| 4,526,375 | A | 7/1985 | Nakade | 273/235 R |
| 4,560,168 | A | 12/1985 | Aoyama | 273/232 |
| 4,638,034 | A | 1/1987 | McClain | 525/369 |
| 4,884,814 | A | 12/1989 | Sullivan | 273/235 R |
| 4,911,451 | A | 3/1990 | Sullivan et al. | 273/235 R |
| 4,925,193 | A | 5/1990 | Melvin et al. | 273/232 |
| 4,960,281 | A | 10/1990 | Aoyama | 273/232 |
| 5,006,297 | A | 4/1991 | Brown et al. | 264/234 |
| 5,155,157 | A | 10/1992 | Statz et al. | 524/423 |
| 5,160,674 | A | 11/1992 | Colton et al. | 264/50 |
| 5,184,828 | A * | 2/1993 | Kim et al. | 473/374 |
| 5,218,057 | A | 6/1993 | Kurkov et al. | 525/369 |
| 5,248,878 | A | 9/1993 | Ihara | 219/121.69 |
| 5,249,804 | A | 10/1993 | Sanchez | 273/232 |
| 5,306,760 | A | 4/1994 | Sullivan | 524/400 |
| 5,324,783 | A | 6/1994 | Sullivan | 525/196 |
| 5,334,673 | A | 8/1994 | Wu | 273/235 R |
| 5,367,028 | A | 11/1994 | Hamada et al. | 525/221 |
| 5,368,304 | A | 11/1994 | Sullivan et al. | 273/220 |
| 5,397,840 | A | 3/1995 | Sullivan et al. | 525/221 |
| 5,407,998 | A | 4/1995 | Horiuchi et al. | 525/133 |
| 5,484,870 | A | 1/1996 | Wu | 528/28 |
| 5,508,351 | A | 4/1996 | Horiuchi et al. | 525/196 |
| 5,542,677 | A | 8/1996 | Sullivan et al. | 473/385 |
| 5,554,698 | A | 9/1996 | Wang et al. | 525/330.2 |
| 5,562,552 | A | 10/1996 | Thurman | 473/379 |
| 5,575,477 | A | 11/1996 | Hwang | 473/379 |
| 5,607,687 | A | 3/1997 | Bezwada et al. | 424/426 |
| 5,616,640 | A | 4/1997 | Harris | 473/378 |

(Continued)

FOREIGN PATENT DOCUMENTS

| | | |
|---|---|---|
| CA | 963380 | 2/1975 |

(Continued)

OTHER PUBLICATIONS

Encyclopedia of Polymer Science and Engineering vol. 8, pp. 404-405.*

(Continued)

*Primary Examiner*—David J. Buttner
(74) *Attorney, Agent, or Firm*—Swidler Berlin LLP

(57) ABSTRACT

The present invention is directed to a golf ball and to a process for forming a golf ball having at least one layer, where the layer is formed of a polymer blend including a highly neutralized polymer formed from an oxa acid, a thermoplastic resin, and an inorganic metal compound, an organic amine, or a combination thereof, wherein greater than about 70 percent of the acid groups in the polymer blend are neutralized.

23 Claims, 2 Drawing Sheets

U.S. PATENT DOCUMENTS

| | | | | |
|---|---|---|---|---|
| 5,631,324 | A | 5/1997 | Rajagopalan et al. | 473/385 |
| 5,688,191 | A | 11/1997 | Cavallaro et al. | 473/373 |
| 5,704,854 | A | 1/1998 | Higuchi et al. | 473/373 |
| 5,713,801 | A | 2/1998 | Aoyama | 473/354 |
| 5,733,428 | A | 3/1998 | Calabria et al. | 264/134 |
| 5,779,561 | A | 7/1998 | Sullivan et al. | 473/373 |
| 5,803,831 | A | 9/1998 | Sullivan et al. | 473/374 |
| 5,820,488 | A | 10/1998 | Sullivan et al. | 473/374 |
| 5,833,553 | A | 11/1998 | Sullivan et al. | 473/374 |
| 5,849,168 | A | 12/1998 | Lutz | 264/755 |
| 5,856,388 | A | 1/1999 | Harris et al. | 524/320 |
| 5,869,578 | A | 2/1999 | Rajagopalan | 525/330.2 |
| 5,885,172 | A | 3/1999 | Hebert et al. | 473/354 |
| 5,919,100 | A | 7/1999 | Boehm et al. | 473/354 |
| 5,929,189 | A | 7/1999 | Ichikawa et al. | 528/76 |
| 5,957,787 | A | 9/1999 | Hwang | 473/379 |
| 5,959,059 | A | 9/1999 | Vedula et al. | 528/76 |
| 5,965,669 | A | 10/1999 | Cavallaro et al. | 525/221 |
| 5,981,654 | A | 11/1999 | Rajagopalan | 525/66 |
| 5,981,658 | A | 11/1999 | Rajagopalan et al. | 525/72 |
| 6,056,842 | A | 5/2000 | Dalton et al. | 156/243 |
| 6,075,223 | A | 6/2000 | Harrison | 219/121.85 |
| 6,099,415 | A | 8/2000 | Lutz | 473/357 |
| 6,114,455 | A | 9/2000 | Dalton | 525/221 |
| 6,129,881 | A | 10/2000 | Puniello | 264/278 |
| 6,149,535 | A | 11/2000 | Bissonnette et al. | 473/354 |
| 6,180,040 | B1 | 1/2001 | Ladd et al. | 264/248 |
| 6,180,722 | B1 | 1/2001 | Dalton et al. | 525/193 |
| 6,207,784 | B1 | 3/2001 | Rajagopalan | 528/71 |
| 6,213,898 | B1 | 4/2001 | Ogg | 473/383 |
| 6,235,230 | B1 | 5/2001 | Puniello | 264/278 |
| 6,241,622 | B1 | 6/2001 | Gobush et al. | 473/199 |
| 6,241,625 | B1 | 6/2001 | Yokota et al. | 473/373 |
| 6,248,804 | B1 | 6/2001 | Lutz | 523/160 |
| 6,255,361 | B1 | 7/2001 | Rajagopalan et al. | 521/97 |
| 6,286,364 | B1 | 9/2001 | Aoyama et al. | 73/65.03 |
| 6,290,615 | B1 | 9/2001 | Ogg | 473/378 |
| 6,309,314 | B1 | 10/2001 | Sullivan et al. | 473/378 |
| 6,315,915 | B1 | 11/2001 | Hebert et al. | 216/67 |
| 6,329,458 | B1 | 12/2001 | Takesue et al. | 524/400 |
| 6,338,684 | B1 | 1/2002 | Winfield et al. | 473/378 |
| 6,368,237 | B1 | 4/2002 | Sullivan | 473/378 |
| 6,379,138 | B1 | 4/2002 | Puniello et al. | 425/116 |
| 6,383,092 | B1 | 5/2002 | Ogg | 473/378 |
| 6,391,955 | B1 | 5/2002 | Rajagopalan et al. | 524/308 |
| 6,409,615 | B1 | 6/2002 | McGuire et al. | 473/383 |
| 6,488,591 | B1 | 12/2002 | Gobush et al. | 473/199 |
| 6,500,073 | B1 | 12/2002 | Pelletier et al. | 473/199 |
| 6,500,495 | B1 | 12/2002 | Lutz | 427/500 |
| 6,653,382 | B1 * | 11/2003 | Statz et al. | 524/400 |
| 2001/0009310 | A1 | 7/2001 | Hebert et al. | |
| 2001/0018375 | A1 | 8/2001 | Hayashi et al. | |
| 2001/0019971 | A1 | 9/2001 | Hayashi et al. | |
| 2002/0025862 | A1 | 2/2002 | Sullivan et al. | |
| 2002/0028885 | A1 | 3/2002 | Sullivan et al. | |
| 2002/0082358 | A1 | 6/2002 | Ohira et al. | |
| 2003/0013549 | A1 | 1/2003 | Rajagopalan et al. | |
| 2003/0032502 | A1 * | 2/2003 | Lee et al. | 473/377 |

FOREIGN PATENT DOCUMENTS

| | | | |
|---|---|---|---|
| EP | 0115190 | B1 | 8/1984 |
| EP | 0104316 | B1 | 11/1987 |
| EP | 0276956 | B1 | 8/1988 |
| WO | WO 93/06137 | | 4/1993 |
| WO | WO 96/23009 | | 8/1996 |
| WO | 96/40377 | | 12/1996 |
| WO | 96/40826 | | 12/1996 |
| WO | WO 97/19114 | | 5/1997 |
| WO | 98/43713 | | 10/1998 |
| WO | WO 01/29129 | | 4/2001 |

OTHER PUBLICATIONS

U.S. Appl. No. 10/228,311, filed Aug. 27, 2002, entitled "Golf Balls Comprising Light Stable Materials and Methods for Making Same".

U.S. Appl. No. 10/190,705, filed Jul. 9, 2002, entitled "Low Compression, Resilent Golf Balls With Rubber Core".

U.S. Appl. No. 09/842,829, filed Apr. 27, 2001, entitled "All Rubber Golf Ball with Hoop-Stress Layer".

U.S. Appl. No. 10/028,826, filed Dec. 28, 2001, entitled "Golf Ball With An Improved Intermediate Layer".

U.S. Appl. No. 10/138,304, filed May 6, 2002, entitled "Golf Ball Incorporating Grafted Metallocene Catalyzed Polymer Blends".

U.S. Appl. No. 10/167,744, filed Jun. 13, 2002, entitled "Golf Ball With Multiple Cover Layers".

U.S. Appl. No. 09/717,136, filed Nov. 22, 2000, entitled "Method of Making Golf Balls".

U.S. Appl. No. 09/742,435, filed Dec. 22, 2000, entitled "Split Vent Pin for Injection Molding".

U.S. Appl. No. 09/841,910, filed Apr. 27, 2001, entitled Multilayer Golf Ball With Hoop-Stress Layer.

U.S. Appl. No. 10/078,417, filed Feb. 21, 2002, entitled "Dimple Patterns for Golf Balls".

U.S. Appl. No. 09/442,845, filed Nov. 18, 1999, entitled "Mold for a Golf Ball" (Japanese Abstract submitted).

U.S. Appl. No. 09/404,164, filed Sep. 27, 1999, entitled "Golf Ball Dimple Pattern".

U.S. Appl. No. 09/989,191, filed Nov. 21, 2001, entitled "Golf Ball Dimples With A Catenary Curve Profile".

U.S. Appl. No. 10/012,538, filed Dec. 12, 2001, entitled "Method of Forming Indicia on a Golf Ball".

U.S. Appl. No. 09/739,469, filed Dec. 18, 2000, entitled "Laser Marking of Golf Balls".

"Polymer Science and technology", Robert O. Ebewele, 1992, pp. 182 and 428.

*Block and Graft Copolymers*, R. Ceresa, Butterworths, London (1962).

* cited by examiner

HIGHLY NEUTRALIZED POLYMER GOLF BALL COMPOSITIONS INCLUDING OXA ACIDS AND METHODS OF MAKING SAME

CROSS-REFERENCE TO RELATED APPLICATIONS

This application is a continuation-in-part of U.S. patent application Ser. No. 10/067,887, filed Feb. 8, 2002, now U.S. Pat. No. 6,844,384, which is a continuation-in-part of U.S. patent application Ser. No. 09/608,566, filed Jun. 30, 2000, now U.S. Pat. No. 6,391,955, which is a continuation in-part of U.S. patent application Ser. No. 09/215,370, filed on Dec. 18, 1998, now U.S. Pat. No. 6,121,384, which is a divisional of U.S. patent application Ser. No. 08/978,510, filed Nov. 25, 1997, now U.S. Pat. No. 5,869,578, which is a continuation of U.S. patent application Ser. No. 08/560,763, filed Nov. 21, 1995, now abandoned, and a continuation-in-part of U.S. patent application Ser. No. 09/225,341, filed on Jan. 5, 1999, now U.S. Pat. No. 6,084,016, which is continuation of U.S. patent application Ser. No. 08/828,636, filed Mar. 31, 1997, now U.S. Pat. No. 5,856,388, which is a continuation-in-part of U.S. patent application Ser. No. 08/482,520, filed Jun. 7, 1995, now U.S. Pat. No. 5,616,640. This application is also a continuation-in-part of U.S. patent application Ser. No. 09/759,329, filed Jan. 16, 2001, now U.S. Pat. No. 6,586,511, which is a continuation of U.S. patent application Ser. No. 09/132,193, filed Aug. 10, 1998, now U.S. Pat. No. 6,255,361, which is a continuation-in-part of U.S. patent application Ser. No. 08/978,510, filed on Nov. 25, 1997, now U.S. Pat. No. 5,869,578, which is a continuation of U.S. patent application Ser. No. 08/560,763, filed on Nov. 21, 1995, now abandoned. Each of these applications is incorporated by reference herein in its entirety.

FIELD OF THE INVENTION

The present invention relates to highly neutralized compositions formed from oxa acids and their salts and acid polymers or partially neutralized polymers for use in golf ball components. In particular, the invention is directed to the use of oxa acids and the salts thereof as a reactive processing aid.

BACKGROUND OF THE INVENTION

Three-piece, wound golf balls with balata covers are preferred by many expert golfers. These balls provide a combination of distance, high spin rate, and control that is not available with other types of golf balls. However, balata is easily damaged in normal play, and lacks the durability required by the average golfer.

Thus, over the past several years, golf ball manufacturers have been using ionomer resins for golf ball cover materials because of their durability, rebound, and scuff resistance characteristics. Ionomer resins are generally understood as copolymers of an olefin and an α,β-unsaturated carboxylic acid, e.g., acrylic acid, methacrylic acid, or maleic acid, wherein the acidic groups are partially neutralized with metal ions such as sodium, lithium, zinc, or magnesium ions. Ionomer-covered balls are impossible to "cut", but also have a very hard "feel", which many golfers find unacceptable. In addition, ionomer-covered golf balls generally have a lower spin rate (attributed to the differences in the composition and construction of both the cover and the core), which makes these type of balls more difficult to draw or fade.

As such, many attempts have been made to produce a golf ball with the control and feel of a wound balata ball and the durability of a solid, two-piece ball, but none have succeeded totally. In various attempts to produce an ideal golf ball, the golfing industry has blended hard ionomer resins (i.e., those ionomer resins having a hardness of about 60 Shore D to about 66 Shore D, as measured in accordance with ASTM method D-2240) with a number of softer polymeric materials, such as softer polyurethanes. However, the blends of the hard ionomer resins with the softer polymeric materials have generally led to numerous processing problems and result in golf balls limited to shorter distance play. For example, whereas blends of one variety of polymer, such as ionomers, have been successfully used, blends of one type of polymer with other non-ionic polymers are typically immiscible, i.e., heterogeneous on a microscopic scale, and incompatible, i.e., heterogeneous on a macroscopic scale, unless strong interactions are present between the polymer components in the mixture. These strong interactions include those observed between carboxylic acid based ionomers and other polymers containing carboxylic acid groups.

In particular, this lack of compatibility exists when an ionomer is blended with a polyolefin homopolymer, copolymer, or terpolymer that does not contain ionic, acidic, basic, or other polar pendant groups, and is not produced with a metallocene catalyst. These mixtures often have poor tensile strength, impact strength, and the like. Hence, the golf balls produced from these incompatible mixtures will have inferior golf ball properties such as poor durability, cut resistance, and the like. In contrast, a compatible blend may be heterogeneous on a microscopic scale, but is homogeneous on a macroscopic scale, and, thus, has useful golf ball properties.

In this regard, U.S. Pat. No. 5,397,840 discloses golf ball covers including a blend of "ionic copolymers" and "non-ionic copolymers". However, the "ionic copolymers" are defined as copolymers of an α-olefin and a metal salt of an α,β-carboxylic acid, and the "non-ionic copolymers" are copolymers or terpolymers containing ethylene or propylene and acrylic or methacrylic acid monomers. Therefore, strong interactions exist between the metal salts of the "ionic copolymers" and the acrylic or methacrylic acid monomers of the "non-ionic copolymers" that allow compatible blends to be formed. These interactions do not exist in prior art blends of ionomers and polymers that are truly non-ionic or non-polar.

In addition, U.S. Pat. No. 5,616,640 to Harris et al. discloses golf ball cover compositions including an oxa acid compound having the formula:

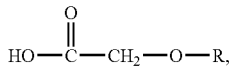

which may be blended with carboxylic acid based ionomers to provide golf balls having an excellent spin rate and good shear resistance. Moreover, U.S. Pat. Nos. 5,869,578 and 6,255,361 are directed to golf balls including saponified ionomers and compatible blends of oxa acids and saponified ionomers.

Those of ordinary skill in the art are aware that increasing the neutralization of ethylene-based ionomers during manufacturing, however, reduces the processability of the material. This is demonstrated by the decreased melt flow index of the resulting material. In fact, in some cases, the melt flow index of the material is decreased to the point that the material does not flow at all. As a result, commercially available ethylene-based ionomers are generally only partially neutralized.

And, while highly neutralized polymers have recently been discussed in U.S. Pat. No. 6,329,458, U.S. Patent Publication Nos. 2001/0019971, 2001/0018375, 2003/0013549, and International Publication No. WO 01/29129, these polymers are produced using fatty acids. In fact, DuPont recently released a highly neutralized polymer produced from a fatty acid under the trade name DuPont® HPF 1000 (formerly known as DPO AD1016-2). Potential compatibility issues remain with these highly neutralized polymers, however, due to their hydrophobic backbone moiety. In addition, the non-neutralized fatty acids may vaporize during injection molding, which may cause molding defects and defects during post-processing, e.g., during painting, coating, and the like.

Thus, a need exists in the golf ball art for a resin material that is easily processed with desirable melt flow and molding characteristics. In addition, a need exists in the art for a method to mold this resin material into highly durable golf balls with improved performance and tailorable to have virtually any combination of feel and spin rate.

SUMMARY OF THE INVENTION

The present invention is directed to highly neutralized polymers produced with oxa acids and salts thereof and their use in golf equipment such as golf ball components, golf shoe components, and golf club components. In particular, the present invention relates to highly neutralized polymer compositions including copolymers of an olefin and an α,β-unsaturated carboxylic acid, e.g., acrylic acid, methacrylic acid, or maleic acid, mixed with at least one oxa acid or a salt thereof and at least one inorganic metal compound or organic amine compound.

In one aspect of the present invention, a golf ball of the present invention has at least one layer formed from a highly neutralized polymer composition including: an oxa-containing component comprising oxa acid, an oxa salt, an oxa ester, or combination thereof; a thermoplastic resin component having an acid functionalized moiety comprising at least one acid group, ionic group, or combination thereof; and a neutralizing component, wherein greater than about 70 percent of the acid functionalized moiety is neutralized. In one embodiment, at least about 90 percent or greater of the acid functionalized moiety is neutralized. In another embodiment, the highly neutralized polymer composition is present in an intermediate layer.

The neutralizing component may include an inorganic metal compound, an organic amine, or a combination thereof. In one embodiment, the neutralizing component includes magnesium oxide, magnesium hydroxide, magnesium carbonate, zinc oxide, zinc acetate, sodium hydroxide, sodium carbonate, calcium oxide, calcium hydroxide, lithium oxide, lithium hydroxide, or mixtures thereof.

In another embodiment, the oxa-containing component is present in an amount of about 0.1 percent to about 50 percent by weight of the composition, the thermoplastic resin component is present in an amount of about 50 percent to about 99 percent by weight of the composition, and the neutralizing component is present in an amount of about 0.5 percent to about 10 percent by weight of the composition.

In yet another embodiment, the oxa-containing component has the general formula:

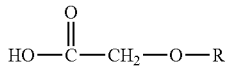

wherein R is an organic moiety selected from the group consisting of moieties having the formula —[CH2—CH2—O]n-R' and alkyl, carbocyclic, and heterocyclic groups, wherein R' is an organic moiety selected from the group consisting of alkyl, carbocyclic, carboxylic acid, heterocyclic groups, and mixtures thereof, and wherein n is at least 1. In particular, the oxa-containing component may include 3,6-dioxaheptanoic acid, 7,7-dimethyl-3,6-dioxaheptanoic acid, 3,6-dioxaheptanoic acid ethyl ester, 3,6-dioxaheptanoic acid dodecyl ester, 2-phenyl-3,6-dioxaheptanoic acid, 2-benzyl-3,6-dioxaheptanoic acid, 2-methyl-3,6-dioxaheptanoic acid, 3,6,9-trioxadecanoic acid, 3,6,9-trioxaheptanoic acid, 2-phenyl-3,6,9-trioxaheptanoic acid, 2-benzyl-3,6,9-trioxaheptanoic acid, 2-decyl-3,6,9-trioxaheptanoic acid, 3,6,9-trioxaundecanedioic acid, 3,6,9,12-tetraoxatridecanoic acid, 3,6,9,12,15-pentaoxahexadecanoic acid, 2-methyl-3,6,9-trioxadecanoic acid, 10,10-dimethyl-3,6,9-trioxadecanoic acid, 2-ethyl-3,6,9,12-tetraoxatridecanoic acid, 10-phenyl-3,6,9-trioxadecanoic acid, 3,6,9-trioxadecanoic acid ethyl ester, 10,10-dimethyl-3,6,9-trioxadecanoic acid ethyl ester, 10,10-dimethyl-3,6,9-trioxadecanoic acid heptadecanyl ester, polyglycol diacid, and mixtures thereof.

In one embodiment, the oxa acid has an acid number of about 50 mg KOH/g or greater. In another embodiment, the oxa acid has a viscosity of about 35 mPAS or greater at 20° C. In still another embodiment, the highly neutralized polymer composition has a melt flow index of about 0.5 grams per 10 minutes at 190° C. and a 2,100 gram load.

The thermoplastic resin component may include at least one of an olefin-unsaturated carboxylic acid random copolymer, an olefin-unsaturated carboxylic acid-unsaturated carboxylate ternary copolymer, an olefin-unsaturated carboxylic acid-unsaturated carboxylate ternary copolymer at least partially neutralized with a metal ion, or mixtures thereof. In one embodiment, the thermoplastic resin component includes at least one of a polyolefin, olefin elastomer, urethane elastomer, polyester elastomer, styrene elastomer blended with a polyamide elastomer, polyurea elastomer, polyamide, polycarbonate, polyimide, polyacrylate, polysilicone, or mixtures thereof.

The present invention is also directed to a golf ball including a core having a hardness of about 30 Shore D or greater and a cover having a hardness of about 50 Shore D or greater, wherein the cover is formed of a highly neutralized polymer composition including: a reactive processing moiety comprising an oxa acid, an oxa salt, an oxa ester, or a combination thereof; a thermoplastic resin component comprising at least one acid group, ionic group, or combination thereof; and a neutralizing component.

In one embodiment, the reactive processing moiety is selected from the group consisting of comprises 3,6-dioxaheptanoic acid, 7,7-dimethyl-3,6-dioxaheptanoic acid, 3,6-dioxaheptanoic acid ethyl ester, 3,6-dioxaheptanoic acid dodecyl ester, 2-phenyl-3,6-dioxaheptanoic acid, 2-benzyl-3,6-dioxaheptanoic acid, 2-methyl-3,6-dioxaheptanoic acid, 3,6,9-trioxadecanoic acid, 3,6,9-trioxaheptanoic acid, 2-phenyl-3,6,9-trioxaheptanoic acid, 2-benzyl-3,6,9-trioxaheptanoic acid, 2-decyl-3,6,9-trioxaheptanoic acid, 3,6,9-trioxaundecanedioic acid, 3,6,9,12-tetraoxatridecanoic acid, 3,6,9,12,15-pentaoxahexadecanoic acid, 2-methyl-3,6,9-trioxadecanoic acid, 10,10-dimethyl-3,6,9-trioxadecanoic acid, 2-ethyl-3,6,9,12-tetraoxatridecanoic acid, 10-phenyl-3,6,9-trioxadecanoic acid, 3,6,9-trioxadecanoic acid ethyl ester, 10,10-dimethyl-3,6,9-trioxadecanoic acid ethyl ester, 10,10-dimethyl-3,6,9-trioxadecanoic acid heptadecanyl ester, polyglycol diacid, and mixtures thereof.

In another embodiment, the core has a diameter of about 1.55 inches or greater. In yet another embodiment, the core diameter is about 1.59 inches or greater. In still another embodiment, the cover has a thickness of about 0.02 inches to about 0.07 inches. In addition, the golf ball may include an intermediate layer that may be formed, at least in part, from a highly neutralized polymer composition.

The present invention also relates to a golf ball including a core having a hardness of about 30 Shore D or greater, at least one intermediate layer having a first hardness, a cover having a second hardness, wherein the ratio of the second hardness to the first hardness is about 0.7 or less, and wherein the cover is formed of a highly neutralized polymer composition including: a reactive processing moiety comprising an oxa acid, an oxa salt, an oxa ester, or a combination thereof; a thermoplastic resin component comprising at least one acid group, ionic group, or combination thereof; and a neutralizing component.

In one embodiment, the ratio of the second hardness to the first hardness is about 0.45 or less. In another embodiment, the reactive processing moiety is present in an amount of about 10 percent to about 30 percent by weight of the highly neutralized polymer composition, wherein the thermoplastic resin component is present in an amount of about 70 percent to about 90 percent by weight of the highly neutralized polymer composition, and wherein the neutralizing component is present in an amount of about 2 percent to about 6 percent by weight of the highly neutralized polymer composition.

In this aspect of the invention, the thermoplastic resin component may include at least one of a polyolefin, olefin elastomer, urethane elastomer, polyester elastomer, styrene elastomer blended with a polyamide elastomer, polyurea elastomer, polyamide, polycarbonate, polyimide, polyacrylate, polysilicone, or mixtures thereof. In addition, the neutralizing component may include magnesium oxide, magnesium hydroxide, magnesium carbonate, zinc oxide, zinc acetate, sodium hydroxide, sodium carbonate, calcium oxide, calcium hydroxide, lithium oxide, lithium hydroxide, or mixtures thereof.

Furthermore, the core may include a center and an outer core layer. And, in one embodiment, the highly neutralized polymer composition further includes at least one density-adjusting filler.

The present invention is also directed to a golf ball having least one layer, the layer formed of a polymer blend including at least one oxa ester. Useful oxa esters include (a) monoesters of the formula:

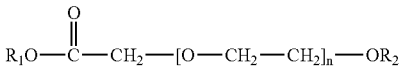

(b) diesters of formula:

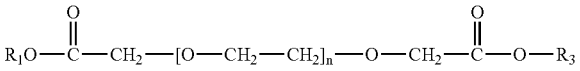

wherein n is an integer greater than or equal to 1, preferably from 1 to 27, $R_1$ and $R_3$ are typically $CH_3$, but may be any organic moiety selected from the group consisting of a linear or branch chained alkyl, a substituted or unsubstituted carbocyclic or heterocyclic groups, and $R_2$ is H or an organic moiety selected from the group consisting of linear and branch chained alkyl, substituted and unsubstituted carbocyclic, and heterocyclic groups;

(c) polymers of the formula

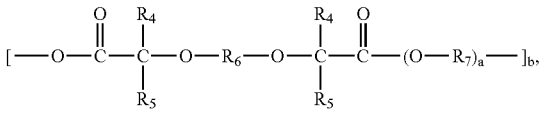

(d) polymers of formula

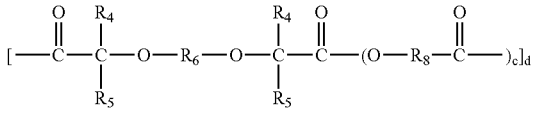

and (e) polymers of formula

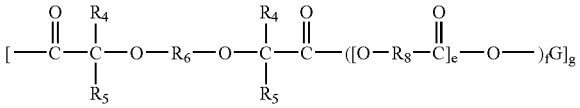

where $R_4$ and $R_5$ are independently selected from the group consisting of hydrogen or an alkyl group containing from 1 to 8 carbon atoms;

a is an integer in the range of from 1 to about 2,000 and preferably from 1 to about 1000; b, d and g are independently an integer in the range of from about 1 to about 10,000 and preferably is in the range of from about 10 to about 1,000 and most preferably in the range of from about 50 to about 200;

c is an integer in the range from 1 to 2000;

e is an integer in the range of from 1 to about 6,000, preferably from 1 to about 1,200, most preferably from about 1 to about 250;

f is an integer from about 1 to about 200;

$R_6$ is an alkylene containing from 2 to 12 carbon atoms or is an oxyalkylene group of formula:

$$—[(CH_2)_h—O—]_i—(CH_2)_j—$$

where h is an integer in the range of from about 2 to about 5, i is an integer in the range of from about 0 to about 2,000 and preferably from 0 to 12, and j is an integer in the range of from about 2 to about 5;

$R_7$ is an alkylene unit containing from 2 to 8 methylene units;

$R_8$ is selected from the group consisting of —C($R_9$)($R_{10}$)—, —($CH_2$), —O—, —$CH_2$—$CH_2$O—$CH_2$—, —$CR_{11}$H—$CH_2$—, —$(CH_2)_4$—, —$(CH_2)_k$, O—C(O)—, and —$(CH_2)_k$—C(O)$^-$$CH_2$;

$R_9$ and $R_{10}$ are independently hydrogen or an alkyl containing from 1 to about 8 carbon atoms;

$R_{11}$ is hydrogen or methyl;

k is an integer of from about 2 to about 6;

G represents the residue minus from 2 to L hydrogen atoms from the hydroxyl groups of an alcohol previously containing from I to about 200 hydroxyl groups; and L is an integer from about 1 to about 200.

Typically a layer of a golf ball including the present invention has a hardness of at least 15 Shore A, a flexural modulus of at least 500 psi, and a specific gravity of at least 0.7. Preferably, the flexural modulus of at least 500 to about 300,000 psi. In addition, a golf ball of the present invention preferably has an Atti compression of about 50 or greater, more preferably about 60 to about 100, and a coefficient of restitution of about 0.7 or greater.

In one embodiment, the thickness of the golf ball cover is preferably about 0.03 inches to about 0.125 inches with about 60 percent or greater dimple coverage, and a core diameter of about 0.5 inches to about 1.63 inches. In another embodiment, the golf ball includes a mantle or intermediate layer with a thickness of about 0.02 inches or greater.

Golf balls of the present invention preferably have a cover layer hardness of about 40 Shore D to about 70 Shore D and a flexural modulus of about 10,000 to about 100,000 psi, an intermediate layer hardness of about 20 Shore D to about 70 Shore D and a flexural modulus of about 500 to about 100,000 psi and a core layer hardness of about 40 Shore A to about 70 Shore D and a flexural modulus of about 500 to 150,000 psi.

Any of the cover, the core or the center, or the at least one optional mantle or intermediate layer may include a density adjusting filler material to increase or decrease the density. The density adjusting filler material may be a metallic powder or a metallic oxide derivative. Preferably, the metallic powder is either titanium, tungsten, tin or copper powder and the metallic oxide derivative is an oxide derivative of titanium, tungsten, copper or tin.

In addition, any of the cover, the core or the center, or the at least one optional mantle or intermediate layer may include a wound tensioned elastomeric material formed from natural or synthetic elastomers or blends thereof. One example of a synthetic elastomer is LYCRA. In one embodiment, the center may be solid, fluid filled or hollow.

The oxa ester may be present in a polymer blend in an amount from about 1 part to about 35 parts, preferably from about 1 part to about 25 parts, and most preferably from about 1 part to about 15 parts, based on 100 parts of the polymer blend. In one embodiment, the polymer blend further includes at least one saponified polymer. In this embodiment, the saponified polymer/oxa ester blend may include from about 1 part to about 35 parts of the oxa ester and from about 99 parts to about 65 parts of the saponified polymer, based on 100 parts of the polymer blend. Preferably, the saponified polymer/oxa ester blend includes from about 1 part to about 25 parts of the oxa ester and from about 99 parts to about 75 parts of the saponified polymer, and, most preferably from about 1 part to about 15 parts of the oxa ester and from about 99 parts to about 85 parts of the saponified polymer, based on 100 parts of the polymer blend.

The saponified polymer component of this invention may have a hardness of about 15 or greater Shore D (as measured by ASTM method D-2240), a flexural modulus of about 500 psi or greater (as measured by ASTM method D-79), preferably about 1000 psi to about 100,000 psi, a specific gravity of about 0.7 or greater, preferably from about 0.75 to about 1, a dynamic shear storage modulus (G') at 23° C. of at least $10^4$ dynes/$cm^2$ (as described in ASTM D 4092-90, ASTM D 5279-93, and ASTM D 4065-94), preferably about $10^6$ to about $10^{10}$ dynes/$cm^2$, and most preferably from about $10^6$ to about $10^9$ dynes/$cm^2$, and a loss tangent (tan δ) of no more than about 1, preferably, no more than about 0.1, and most preferably from about 0.001 to about 0.01 at 23° C.

DETAILED DESCRIPTION OF THE INVENTION

Figure 1:
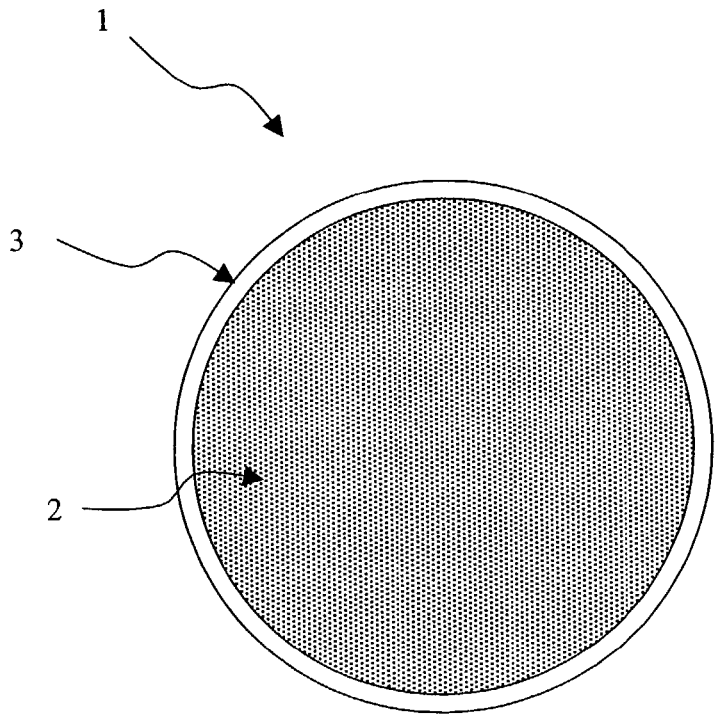
FIG. 1 is a cross-sectional view of a two-piece golf ball according to the invention with a one-piece core.

The present invention is directed to compositions including oxa acids and/or oxa acids salts combined with an non-neutralized or partially neutralized polymers to produce highly neutralized polymers for use in golf ball components. The present invention also relates to golf balls including at least one foamed or unfoamed layer that includes at least one oxa ester, at least one saponified polymer, saponified polymer/oxa ester blends, oxa acids, oxa acid/oxa ester blends, all of which may be blended with conventional ionomers and thermoplastic ionomers, grafted metallocene catalyzed polymers or polymer blends, non-grafted metallocene catalyzed polymers or polymer blends, as well as additives well known in the golf ball art. The compositions of the invention are contemplated for use in golf balls of any construction, e.g., one-piece, two-piece, and three-piece balls.

As used herein, the terms "conventional ionomers" and "conventional thermoplastic ionomers", refer to copolymers and terpolymers including an a-olefin, an α,β-unsaturated carboxylic acid, and, optionally, a softening monomer, such as an acrylate class ester, where at least a portion the carboxylic acid groups on the polymer have been neutralized with at least one metal atom, such as lithium, sodium, potassium, cesium, magnesium, calcium, barium, zinc, manganese, copper, and aluminum. In addition, as used herein, the term "metallocene catalyzed polymer" refers to any polymer, copolymer, or terpolymer, and, in particular, any polyolefin, polymerized using a metallocene catalyst. The term "grafted metallocene catalyzed polymer" refers to any metallocene catalyzed polymer in which the metallocene catalyzed polymer has been subjected to a post-polymerization reaction to graft at least one functional group onto the metallocene catalyzed polymer. Similarly, the term "non-grafted metallocene catalyzed polymer" refers to any metallocene catalyzed polymer in which the metallocene catalyzed polymer has not been subjected to such a post-polymerization reaction. Accordingly, the term "metallocene catalyzed polymer" encompasses both non-grafted metallocene catalyzed polymers and grafted metallocene catalyzed polymers.

Compositions of the Invention

As briefly discussed above, the compositions of the present invention may include saponified polymers, oxa esters, oxa acids, highly neutralized polymers, and blends thereof. For example, in one embodiment, an oxa acid and/or a salt thereof is combined with a thermoplastic resin component having an acid or ionic group, i.e., an acid polymer or partially neutralized polymer, to produce a highly neutralized polymer. As used herein, a partially neutralized polymer should be understood to mean polymers with about 10 to about 70 percent of the acid groups neutralized. In another aspect of the invention, the compositions of the invention include an oxa ester/saponified polymer blend. The compositions of the invention, components of the compositions, ball construction, and ball properties are discussed in detail below.

Highly Neutralized Polymers

Unlike methods using fatty acid moieties to produce highly neutralized polymers, the present invention employs a novel combination of an oxa acid and/or a salts thereof, a thermoplastic resin component, and an inorganic metal compound or organic amine compound to produce highly neutralized polymers. In this aspect of the invention, the oxa acid acts as a reactive processing aid to avoid processing problems typically encountered with other methods of making highly neutralized polymers. As used herein, the term highly neutralized polymer is intended to cover those polymers having greater than about 70 percent of the acid groups neutralized. In one embodiment, about 80 percent or greater of the acid groups are neutralized. In another embodiment, about 90 percent or greater of the acid groups are neutralized. In still another embodiment, all of the acid groups (100 percent) in the polymer composition are neutralized.

Thus, highly neutralized polymers according to the invention may be formed from a composition including at least one oxa acid, oxa acid salt, or oxa ester and at least one thermoplastic resin component having an acid or ionic group. In one embodiment, about 0.1 percent to about 50 percent by weight of at least one oxa acid, oxa salt, oxa ester, or combination thereof, preferably about 1 percent to about 50 percent by weight of the composition, is combined with about 50 percent to about 99 percent by weight thermoplastic resin component to form a highly neutralized polymer composition. In addition, at least one inorganic metal compound or organic amine compound is preferably included in the composition. For example, about 0.5 percent to about 10 percent by weight inorganic metal compound or organic amine compound may be used in the compositions of the invention.

In another embodiment, a highly neutralized polymer composition according to the present invention includes about 5 percent to about 40 percent by weight of at least one oxa acid, oxa salt, or combination thereof, about 60 percent to about 95 percent by weight thermoplastic resin component to form a highly neutralized polymer composition. In addition, about 1 percent to about 8 percent by weight inorganic metal compound or organic amine compound may be used in the compositions of the invention. In still another embodiment, the highly neutralized polymer composition includes about 10 percent to about 30 percent by weight of at least one oxa acid, about 70 percent to about 90 percent by weight of at least one thermoplastic resin component, and about 2 percent to about 6 percent by weight of an inorganic metal compound, organic amine, or a combination thereof.

Oxa Acids and Salts Thereof

For the purposes of the present invention, any oxa acid that functions as a reactive processing moiety may be used in the compositions of the invention. In another embodiment, the oxa acid has the following formula:

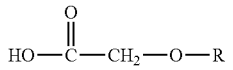

wherein R is an organic moiety selected from the group consisting of moieties having the formula —[$CH_2$—$CH_2$—O]$_n$—R' and alkyl, carbocyclic, and heterocyclic groups, wherein R' is an organic moiety selected from the group consisting of alkyl, carbocyclic, carboxylic acid, heterocyclic groups, and mixtures thereof, and wherein n is at least 1.

Numerous oxa acid compounds useful in the compositions of the present invention are available from Hoechst Celanese Corporation, Fine Chemicals Division under the trade name "Oxa Acids." In particular, the oxa acid, oxa acid salt, or mixture thereof may include 3,6-dioxaheptanoic acid, 7,7-dimethyl-3,6-dioxaheptanoic acid, 3,6-dioxaheptanoic acid ethyl ester, 3,6-dioxaheptanoic acid dodecyl ester, 2-phenyl-3,6-dioxaheptanoic acid, 2-benzyl-3,6-dioxaheptanoic acid, 2-methyl-3,6-dioxaheptanoic acid, 3,6,9-trioxadecanoic acid, 3,6,9-trioxaheptanoic acid, 2-phenyl-3,6,9-trioxaheptanoic acid, 2-benzyl-3,6,9-trioxaheptanoic acid, 2-decyl-3,6,9-trioxaheptanoic acid, 3,6,9-trioxaundecanedioic acid, 3,6,9,12-tetraoxatridecanoic acid, 3,6,9,12,15-pentaoxahexadecanoic acid, 2-methyl-3,6,9-trioxadecanoic acid, 10,10-dimethyl-3,6,9-trioxadecanoic acid, 2-ethyl-3,6,9,12-tetraoxatridecanoic acid, 10-phenyl-3,6,9-trioxadecanoic acid, 3,6,9-trioxadecanoic acid ethyl ester, 10,10-dimethyl-3,6,9-trioxadecanoic acid ethyl ester, 10,10-dimethyl-3,6,9-trioxadecanoic acid heptadecanyl ester, polyglycol diacid, and mixtures thereof. In one embodiment, the oxa acid includes 3,6-dioxaheptanoic acid, 3,6,9 trioxadecanoic acid, 3,6,9-trioxaundecanedioic acid, polyglycol diacid (where n=about 10 to about 12), and mixtures thereof, which have the following formulae:

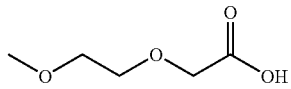

3,6-Dioxaheptanoic acid

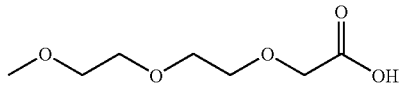

3,6,9-trioxadecanoic acid

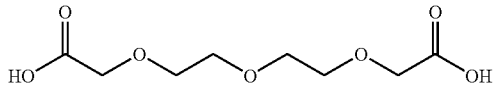

3,6,9-trioxaundecanedioic acid

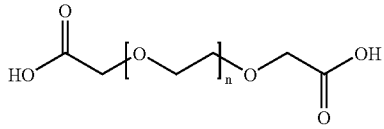

polyglycol diacid
(where n = about 10 to about 12)

The oxa acid preferably has an acid number (calculated by dividing acid equivalent weight to 56,100) of at least about 10 mg KOH/g, preferably from about 20 mg KOH/g to about 420 mg KOH/g, more preferably from about 25 mg KOH/g to about 150 mg KOH/g, and most preferably from about 30 mg KOH/g to about 75 mg KOH/g. In one embodiment, the acid number of the oxa acid is about 50 mg KOH/g or greater.

The viscosity of the oxa acid is preferably about 35 mPAS at 20° C. In one embodiment, the viscosity is about 40 mPAS or greater. In another embodiment, the oxa acid has a viscosity of about 45 mPAS or greater.

The thermoplastic resin component may include any suitable olefin-unsaturated carboxylic acid random copolymer, any olefin-unsaturated carboxylic acid-unsaturated carboxylate ternary copolymer, any olefin-unsaturated carboxylic acid-unsaturated carboxylate ternary copolymer at least partially neutralized with a metal ion, and mixtures thereof. In one embodiment, the thermoplastic resin component for use in the present invention includes polyolefins, olefin elastomers, urethane elastomers, polyester elastomers, styrene elastomers, polyamide elastomers, polyurea elastomers, polyamides, polycarbonates, polyimides, polyacrylates, polysilicones, or mixtures thereof. Thus, the thermoplastic resin component of the invention preferably includes at least one acid group, ionic group, or combination thereof.

In one embodiment, the thermoplastic resin component is an ionic copolymer or terpolymer of ethylene based on an α,β-unsaturated carboxylic acid, such as acrylic acid or methacrylic acid. Ethylene methacrylic acid ionomers and ethylene acrylic acid ionomers and their terpolymers are sold commercially under the trade names SURLYN® and IOTEK® or ESCOR®, which are manufactured by DuPont and Exxon, respectively. These are copolymers or terpolymers of ethylene and methacrylic acid or acrylic acid at least partially neutralized to about 10 to about 70 percent with salts of zinc, sodium, lithium, magnesium, potassium, calcium, manganese, nickel or the like. The carboxylic acid groups may also include methacrylic, crotonic, maleic, fumaric or itaconic acid. The salts are the reaction product of an olefin having from 2 to 10 carbon atoms and an unsaturated monocarboxylic acid having 3 to 8 carbon atoms.

In one embodiment, the thermoplastic resin component includes at least one ionomer, such as acid-containing ethylene copolymer ionomers, including E/X/Y terpolymers where E is ethylene, X is an acrylate or methacrylate-based softening comonomer present in about 0 to 50 weight percent, and Y is acrylic or methacrylic acid present in about 5 to 35 weight percent. In another embodiment, the acrylic or methacrylic acid is present in about 5 to 30 weight percent, more preferably 8 to 25 weight percent, and most preferably 8 to 20 weight percent.

The thermoplastic resin component may also include so-called "low acid" and "high acid" ionomers, as well as blends thereof. In general, ionic copolymers including up to about 15 percent acid are considered "low acid" ionomers, while those including greater than about 15 percent acid are considered "high acid" ionomers.

Use of a low acid ionomeric composition in a golf ball is believed to impart high spin. Thus, in one embodiment, the thermoplastic resin includes a low acid ionomer where the acid is present in about 5 to 15 weight percent and optionally includes a softening comonomer, e.g., iso- or n-butylacrylate, to produce a softer terpolymer. The softening comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

In another embodiment, the thermoplastic resin composition includes at least one high acid ionomer, to produce a composition for use in a golf ball for low spin rate and maximum distance. In this aspect, the acrylic or methacrylic acid is present in about 15 to about 35 weight percent, making the ionomer a high modulus ionomer. In one embodiment, the high modulus ionomer includes about 16 percent by weight of a carboxylic acid, preferably from about 17 percent to about 25 percent by weight of a carboxylic acid, more preferably from about 18.5 percent to about 21.5 percent by weight of a carboxylic acid. In some circumstances, an additional comonomer such as an acrylate ester (i.e., iso- or n-butylacrylate, etc.) can also be included to produce a softer terpolymer. The additional comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

Consequently, examples of a number of copolymers suitable for use to produce the high modulus ionomers include, but are not limited to, high acid embodiments of an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, and the like.

The inorganic metal compound may include any compound capable of neutralizing the acid groups in the thermoplastic resin component. For example, monoxide or hydroxide may be used with the present invention. High reactivity with the thermoplastic and the absence of organic compounds in the reaction by-products enable the degree of neutralization of the present invention. Examples of metal ions that may be used in the inorganic metal compound include, but are not limited to, lithium (Li), sodium (Na), potassium (K), calcium (Ca), barium (Ba), magnesium (Mg), zinc (Zn), aluminum (Al), nickel (Ni), iron (Fe), copper (Cu), manganese (Mn), tin (Sn), lead (Pb), and cobalt (Co). To achieve the unique combination of a high degree of neutralization and good flow, the neutralization of the composition preferably involves neutralization of the acid groups with transition metal ions, e.g., Zn, and alkali metal and/or alkaline earth metal ions, e.g., Li, Na, Ca, and Mg. Because transition metal ions have weaker ionic cohesion than alkali metal and alkaline earth metal ions, however, the use of transition metal ions to neutralize some of the acid groups may provide a substantial improvement in the flow characteristics. The ratio between the transition metal ions and the alkali metal and/or alkaline earth metal ions may be adjusted as appropriate. For example, in one embodiment, a ratio of the transition metal ion to alkali metal or alkali earth metal ions is from about 10:90 to about 90:10. In another embodiment, the ratio is about 20:80 to about 80:20 transition metal ion to alkali metal or alkali earth metal ion.

Thus, non-limiting examples of inorganic metal compounds may include basic inorganic fillers containing the above metal ions, such as oxides, acetates, hydroxides, carbonates, nitrates, and derivatives of Li, Na, K, Mg, Ca, Ba, Mn, Ni, Cu, Zn, and Al metal ions. In one embodiment, the inorganic metal compound includes magnesium oxide, magnesium hydroxide, magnesium carbonate, zinc oxide, zinc acetate, sodium hydroxide, sodium carbonate, calcium oxide, calcium hydroxide, lithium oxide, lithium hydroxide, and mixtures thereof.

The highly neutralized polymer composition may be prepared by mixing and heating the thermoplastic resin component, the oxa acid, oxa salt, or combination thereof, and the inorganic metal compound or organic amine compound in any well-known manner. For example, heat mixing may be achieved by mixing the components in an internal mixer, such as a twin-screw extruder, a Banbury mixer, or a kneader, and heating the composition at a temperature of about 150° C. to about 250° C. Where various additives are to be added, any suitable method may be used to incorporate the additives together with the essential components. For example, the essential components and the additives are simultaneously heated and mixed. Alternatively, the essential components are premixed before the additives are added thereto and the overall composition heated and mixed.

The highly neutralized polymer may include fatty acids, such as those disclosed in U.S. Patent Publication No. 2003/0013549, which is incorporated in its entirety by reference herein, providing that all of the fatty acids are neutralized. That is, the excess fatty acids are neutralized with excess metallic salt. As discussed, highly neutralized polymers formed from fatty acids typically have processability problems, which usually stem from a very low melt flow index. However, too high of a melt flow index may also cause processing problems. Therefore, the highly neutralized polymer of the present invention preferably has a melt flow index of about 0.5 g/10 min or greater at a temperature of 190° C. under a load of 2100 g. In addition, the melt flow index of the highly neutralized polymer is preferably no greater than about 20 g/10 min, preferably about 15 g/10 min or less. In one embodiment, the melt flow index of the highly neutralized polymer composition is about 1.0 g/10 min or greater. In yet another embodiment, the melt flow index is about 1.5 g/10 min or greater. In still another embodiment, the melt flow index if about 2 g/10 min or greater.

In addition, the specific gravity of the highly neutralized polymer is not critical, however, preferably the specific gravity is about 0.9 or greater. In one embodiment, the specific gravity of the highly neutralized polymer is about 1.5 or less. For example, the specific gravity of the highly neutralized polymer may be from about 0.9 to about 1.3.

Saponified Polymers and Polymer Blends

The compositions of the invention may also include saponified polymers. As used herein, the terms "saponified polymer" and "saponified ionomer" refer to a polymer including at least one olefin and at least one unsaturated monomer that contains a pendant ester group, where at least some of the pendant ester groups have been hydrolyzed or saponified. Saponified ionomers differ from prior art ionomers in that any pendant groups that are not modified by the saponification process are ester groups in contrast to the pendant carboxylic acid groups that remain after neutralization in prior art ionomers.

Saponified polymers useful in the invention can be made from polymers of formula 1:

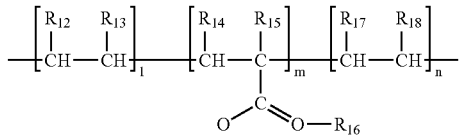

(I)

wherein:

$R_{12}$ and $R_{14}$ are independently hydrogen, alkyl such as methyl, ethyl, and branched or straight chain propyl, butyl, pentyl, hexyl, heptyl, and octyl;

$R_{13}$ and $R_{15}$ are independently hydrogen, lower alkyl including $C_1$–$C_5$ carbocyclic, or aromatic;

$R_{16}$ is selected from the group consisting of $C_nH_{2n+1}$, for n=1 to 18 (which includes, for example, $CH_3$, $C_2H_5$, $C_3$, $H_7$, $C_4$, $H_9$, $C_5H_{11}$, $C_6H$, $_{13}$, $C_7$, $H_{15}$, $C_9H_{19}$, $C_{10}$, $H_{21}$,) and phenyl, in which from 0 to 5 H within R,6 can be replaced by substituents selected from the group consisting of COOH, $SO_3H$, $NH_2$, succinic anhydride and their salts, or $R_{16}$ can be replaced by substituents selected from the group consisting of F, Cl, Br, I, OH, SH, epoxy, silicone, lower alkyl esters, lower alkyl ethers, and aromatic rings, wherein optionally $R_{15}$ and $R_{16}$ can be combined to form a bicyclic ring;

$R_{17}$ and $R_{18}$ are independently hydrogen, lower alkyl including $C_1$–$C_5$, carbocyclic, or aromatic;

wherein 1, m and n are the relative percentages of each co-monomer. Saponified polymers can also be formed from polymers of formula II:

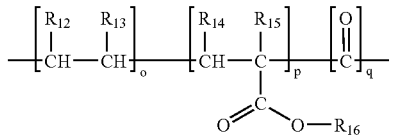

(II)

wherein:

$R_{12}$, $R_{13}$, $R_{14}$, $R_{15}$, and $R_{16}$ are as defined above; and wherein o, p and q are the relative percentages of each co-monomer;

from polymers of formula III:

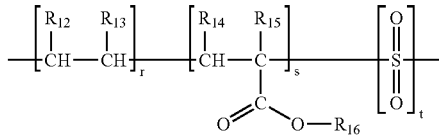

(III)

wherein:

$R_{12}$, $R_{13}$, $R_{14}$, $R_{15}$, and $R_{16}$ are as defined above; and wherein r, s and t are the relative percentages of each co-monomer;

and from polymers of formula IV:

(IV)

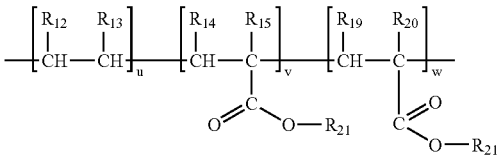

wherein:

$R_{12}$, $R_{13}$, $R_{14}$, $R_{15}$, and $R_{16}$ are as defined above; $R_{19}$ is hydrogen, lower alkyl including C,–$C_5$, carbocyclic, or aromatic; $R_{20}$ is hydrogen or lower alkyl including $C_1$–$C_5$; and $R_{21}$, is hydrogen, or is selected from the group consisting of $C_nH_{2n+1}$, for n=1 to 18 and phenyl, in which from 0 to 5 H within $R_{21}$, can be replaced by substituents selected from the group consisting of COOH, $SO_3H$, $NH_2$, succinic anhydride and their salts, or $R_{21}$, can be replaced by substituents selected from the group consisting of F, Cl, Br, I, OH, SH, epoxy, silicon, lower alkyl esters, lower alkyl ethers and aromatic rings, wherein optionally $R_{20}$ and $R_{21}$ can be combined to form a bicyclic ring; and wherein u, v and w are the relative percentages of each co-monomer. In addition, saponified polymers can be formed from polymers of formula V:

(V)

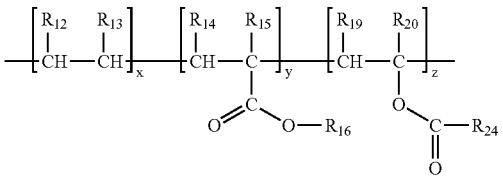

wherein:

$R_{12}$–$R_{16}$ are as defined above; $R_{22}$ is hydrogen, lower alkyl including $C_1$–$C_5$, carbocyclic, or aromatic; $R_{23}$ is hydrogen or lower alkyl including C,–$C_5$; and $R_{24}$ is hydrogen or is selected from the group consisting of $C_nH_{2n+1}$ for n=1 to 18 and phenyl, in which from 0 to 5 H within $R_{24}$ can be replaced by substituents selected from the group consisting of COON, $SO_3H$, $NH_2$, succinic anhydride and their salts, or $R_{24}$ can be replaced by substituents selected from the group consisting of F, Cl, Br, 1, OH, SH, epoxy, silicone, lower alkyl esters, lower alkyl ethers and aromatic rings; and $R_{24}$ is the same as $R_{21}$ wherein optionally $R_{23}$ and $R_{24}$ can be combined to form a bicyclic ring; and wherein x, y and z are the relative percentages of each co-monomer.

In each of the polymers described above, $R_2$ and $R_3$ can be any combination of alkyl, carbocyclic or aromatic groups, for example, 1-cyclohexylpropyl, benzyl cyclohexylmethyl, 2-cyclohexylpropyl, 2,2-methylcyclohexylpropyl, 2,2-methylphenylpropyl, 2,2-methylphenylbutyl. Comonomer units according to the above formulae are easily manufactured according to techniques and synthetic strategies well known to the skilled artisan. These comonomers are also commercially available from a number of commercial sources.

As used herein with regard to saponified polymers and oxa esters, the phrase "branched or straight chain alkyl" means any substituted or unsubstituted acyclic carbon-containing compounds. Examples of alkyl groups include lower alkyl, for example, methyl, ethyl, n-propyl, iso-propyl, n-butyl, iso-butyl or tert-butyl; upper alkyl, for example, octyl, nonyl, decyl, and the like; and lower alkylene, for example, ethylene, propylene, butylene, pentene, hexene, heptene, octene, norbomene, nonene, decene and the like. The ordinary skilled artisan is familiar with numerous linear and branched alkyl groups, which are within the scope of the present invention.

In addition, such alkyl groups may also contain various substituents in which one or more hydrogen atoms has been replaced by a functional group. Functional groups include, but are not limited to hydroxyl, amino, carboxyl, sulfonic amide, ester, ether, phosphates, thiol, nitro, silane and halogen (fluorine, chlorine, bromine and iodine), to mention but a few.

As used herein, "substituted and unsubstituted carbocyclic" means cyclic carbon-containing compounds, including, but not limited to cyclopentyl, cyclohexyl, cycloheptyl, adamantyl, and the like. Such cyclic groups may also contain various substituents in which one or more hydrogen atoms has been replaced by a functional group. Such functional groups include those described above, and lower alkyl groups having from 1–28 carbon atoms. The cyclic groups of the invention may further include a heteroatom.

As used herein, "substituted and unsubstituted aryl groups" refers to any functional group including a hydrocarbon ring having a system of conjugated double bonds, such as phenyl, naphthyl, anisyl, toluyl, xylenyl and the like. According to the present invention, aryl also includes heteroaryl groups, e.g., pyrimidine or thiophene. These aryl groups may also be substituted with any number of a variety of functional groups. In addition to the functional groups described above in connection with substituted alkyl groups and carbocyclic groups, functional groups on the aryl groups can include nitro groups.

As used herein, "heterocyclic groups" means closed cyclic carbon-containing compounds wherein one or more of the atoms in the ring is an element other than carbon, e.g. sulfur, nitrogen, etc, including but not limited to pyridine, pyrole, furan, thiophene, and purine.

Saponified polymers can be random, block or alternating polymers and may be made by blending two, three, four, five or more different monomers according to processes well known to one of ordinary skill in the art. Additionally, the subject polymers may be isotactic, syndiotactic or atactic, or any combination of these forms of types of polymers. The pendant groups creating the isotactic, syndiotactic or atactic polymers can be chosen to determine the interactions between the different polymer chains making up the resin to control the final properties of the resins used in golf ball covers. Aromatic and cyclic olefins can be used in the present invention as well as such specific groups as methyl and phenyl.

The comonomers described herein can be combined in a variety of ways to provide a final copolymer with a variety of characteristics. The letters k, n, q, t and w represent numbers that can independently range from 1–99 percent, preferably from 10–95 percent, more preferably from 10–70 percent and, most preferably, from about 10–50 percent. The coefficients e, o, r, u and x can independently range from 99–1 percent, preferably from 90–5 percent, more preferably from 90–30 percent, and most preferred from 90–50 percent, and m, p, s, v and y can independently range from 0 to 49 percent.

Graft copolymers of the saponified polymers described above can also be prepared for use in forming golf balls. For example, graft polymers can be produced such that the graft segment making up the linkage between polymer chains includes an anhydride, wherein "anhydride" is taken to mean a compound having the formula:

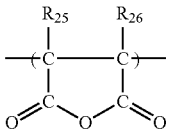

wherein $R_{25}$ and $R_{26}$ are the same or different and are chosen from among hydrogen, linear or branched chain alkyl and substituted or unsubstituted carboxylic groups. Alternately, however, other grafting agents containing double or triple bonds can be used. Examples of these materials include, but are not limited to, acrylates, styrene and butadiene.

Grafting the polymer molecules of the present invention can be accomplished according to any technique known in the art. See, e.g., *Block and Graft Copolymers*, by R. Ceresa, pub. by Butterworths, London, U.S. (1962), incorporated by reference herein. It is preferred that any grafting of the polymers of the present invention be accomplished by adding from about 1 to about 50 percent, or preferably from about 1 to about 25 percent and most preferably from about 1 to about 15 percent of a grafting agent, such as an anhydride according to the formula above. The grafting agents can be added either as a solid or a non-aqueous liquid, to a polymer according to the present invention. Such post reaction grafting can make the final grafted polymer more flexible.

In one embodiment, the polymers used for saponification include: (1) a first monomeric component including an olefinic monomer having from 2 to 8 carbon atoms; (2) a second monomeric component including an unsaturated carboxylic acid based acrylate class ester having from 4 to 22 carbon atoms; and (3) an optional third monomeric component including at least one monomer selected from the group consisting of carbon monoxide, sulfur dioxide, an anhydride monomer, an unsaturated monocarboxylic acid, an olefin having from 2 to 8 carbon atoms and a vinyl ester or a vinyl ether of an alkyl acid having from 4 to 21 carbon atoms.

Polymers that can be saponified for use in the present invention can be synthesized by a variety of methods, including metallocene catalysis, since it is well known in the art of polymer synthesis that many different synthetic protocols can be used to prepare a given compound. Different routes can involve more or less expensive reagents, easier or more difficult separation or purification procedures, straightforward or cumbersome scale-up, and higher or lower yield. The skilled synthetic polymer chemist knows well how to balance the competing characteristics of synthetic strategies. Thus, the saponified polymers useful in the present invention are not limited by the choice of synthetic strategy, and any synthetic strategy that yields the saponified polymers described above can be used.

One non-limiting example of saponified polymer synthesis includes adding a metal base or metal salt in the form of a solid or a solution to a polymer, such as the polymers described above. The metal base includes at least one metallic cation, such as lithium, sodium, potassium, cesium, magnesium, calcium, barium, zinc, manganese, copper, aluminum, and at least one anion, such as hydroxide, alkoxide, acetate, carbonate, bicarbonate, oxide, formate, or nitrate. In one embodiment, the metal base is in the form of a solid, such as a powder or a pellet. Powdered bases used in the invention preferably have an average powder particle diameter of at least 1 to 500 microns, more preferably 10 to 100 microns. In the case of pellets, substantially any commercially available pellet particle size can be used. In another embodiment, the metal base can be added in the form of a solution. Preferably, the solution is non-aqueous so that difficulties arising from incomplete removal of water during subsequent processing and use are avoided. Such non-aqueous solutions typically include solvents such as alcohol, acetic acid and acetic anhydride, although other solvents may, of course, be used.

The polymers described herein may be saponified or hydrolyzed by introducing the polymer into an extruder inlet zone, and melting and mixing the polymer in the inlet zone; passing the molten polymer through an addition zone within the extruder downstream from the inlet zone; and adding a metal base into the molten polymer as it passes through the addition zone. The base may be added to the molten polymer under saponification conditions until the polymer is at least partially saponified, as indicated by, for example, its melt index or by titrating versus an acid.

However, when using a metal base, the metal base is preferably mixed with the polymer under non-saponification conditions. Instead of simultaneously mixing and saponifying or hydrolyzing as practiced in the prior art, these operations are carried out separately. In the first step, the polymer is heated to a substantially molten state at a temperature typically between about 50–350° C., depending upon the polymer chosen, to facilitate subsequent mixing with a metal base. This pre-heating step assures a greater degree of homogeneity in the final product, and provides a final product having correspondingly improved properties.

In the next step, the metal base is added to the molten polymer, and the polymer and metal base are extensively mixed under conditions in which no substantial hydrolysis occurs. A sufficient amount of metal base must be added overall to obtain a degree of saponification of the polymer between about 1 and about 50 percent. The mixing is carried out at a temperature slightly higher than the melting temperature of the polymer. For mixing on an extruder, the screw speed can be varied between about 20–500 rpm, depending upon the material's viscosity, i.e., the higher the viscosity, the greater the screw rpm required. Furthermore, as would be well understood by one of ordinary skill in the art, the depth of the conveying element of the extruder is chosen to prevent substantial hydrolysis of the material during mixing.

Alternately, the mixing may be accomplished using a roll mill. In such a case, the cylinder roll speed is adjusted to between about 5–100 rpm depending upon the viscosity of the material. Additionally, the mill gap is adjusted as necessary to control the amount of shear, and thus the degree of hydrolysis. The metal base may be added all at once to the molten polymer, or alternately it may be introduced in batches or stages.

In a third step, conditions are provided such that a hydrolysis or saponification reaction occurs between the polymer and the metal base. Saponification is achieved by continuous mixing of the polymer and base at an elevated temperature, which is substantially higher than the melting point temperature.

This process offers several improvements over the methods disclosed in the prior art. First, it provides for greater ease of mixing of the reactants before the reaction begins.

Because the melt viscosity of the non-salt polymer is much lower than the salt polymer form, the melt mixing of the polymer and metal base is more readily carried out with lower input power requirements. Additionally, mixing of polymer and metal base is more uniform because there are no substantially hydrolyzed or saponified regions of high melt viscosity present within regions that have not yet reacted and, therefore, have low melt viscosity. Furthermore, the degree of mixing or dispersion of the base in the polymer is more easily controlled since melt viscosity is more uniform throughout the volume of molten polymer. Using this method, once substantial saponification begins, the reaction is thought to be more uniform than the methods previously disclosed.

This process is preferably accomplished using a twin screw extruder wherein the twin screw extruder includes melting, addition, and mixing zone means. The process can further be accomplished using a master batch including a concentrated amount of metal base in a polymer, with the same or different composition as the polymer introduced into the inlet zone, wherein the master batch is added from a side-stream extruder. The side-stream extruder can be a twin screw extruder including melting, addition, and mixing zone means.

Alternatively, another process useful for saponification according to the invention involves introducing the polymer into an inlet zone of an extruder, and melting and mixing the polymer in the inlet zone; passing the molten polymer through at least two addition zones connected in series; and adding a portion of a metal base into the molten polymer as it passes through each addition zone until the polymer is at least partially saponified.

This process can be accomplished using a twin screw extruder wherein the twin screw extruder includes melting, addition, and mixing zone means. The process can further be accomplished using a single or a plurality of master batches including a concentrated amount of metal base in a polymer, with the same or different composition as the polymer introduced into the inlet zone, and with the same or different amount of metal base as the other master batches, wherein the master batch is added from a side-stream extruder. The process can be accomplished with a single or with multiple side-stream extruders which are twin screw extruders including melting, addition, and mixing zone means.

Oxa Esters

The compositions of the invention may also include at least one oxa ester or oxa ester blend. As used herein, the term oxa ester may include:

(a) monoesters of the formula:

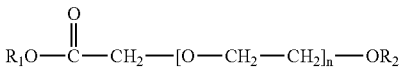

(b) diesters of formula:

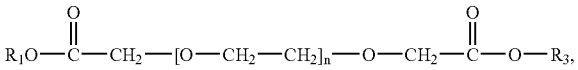

wherein n is an integer greater than or equal to 1, preferably from 1 to 27, $R_1$ and $R_3$ are typically $CH_3$, but may be any organic moiety selected from the group consisting of a linear or branch chained alkyl, a substituted or unsubstituted carbocyclic or heterocyclic groups, and $R_2$ is H or an organic moiety selected from the group consisting of linear and branch chained alkyl, substituted and unsubstituted carbocyclic, and heterocyclic groups;

(c) polymers of formula

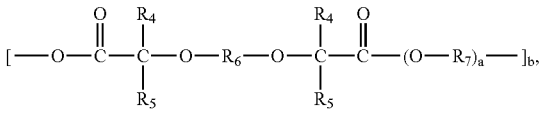

(d) polymers of formula

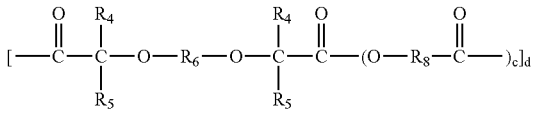

and (e) polymers of formula

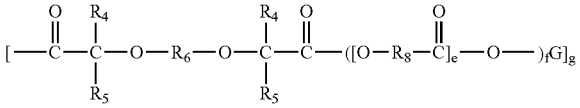

where $R_4$ and $R_5$ are independently selected from the group consisting of hydrogen or an alkyl group containing from 1 to 8 carbon atoms;

a is an integer in the range of from 1 to about 2,000 and preferably from 1 to about 1000;

b, d and g are independently an integer in the range of from about 1 to about 10,000 and preferably is in the range of from about 10 to about 1,000 and most preferably in the range of from about 50 to about 200;

c is an integer in the range of from 1 to 2000 e is an integer in the range of from 1 to about 6,000, preferably from 1 to about 1,200, most preferably from about 1 to about 250;

f is an integer from about 1 to about 200;

$R_6$ is an alkylene containing from 2 to 12 carbon atoms or is an oxyalkylene group of formula:

$$—[(CH_2)_h—O—]_i—(CH_2)_j—$$

where h is an integer in the range of from about 2 to about 5, i is an integer in the range of from about 0 to about 2,000 and preferably from 0 to 12, and j is an integer in the range of from about 2 to about 5;

$R_7$ is an alkylene unit containing from 2 to 8 methylene units;

$R_8$ is selected from the group consisting of $—C(R_9)(R_{,10})—$, $(CH_2)_3—O—$, $—CH_2CH_2O—CH_2$; $—CR_{11}H—CH_2$, $—(CH_2)_4—(CH_{2,})_k—O—C(O)—$, and $^-(CH_2)k^-C(O)^-CH_2$;

$R_9$ and $R_{10}$ are independently hydrogen or an alkyl containing from 1 to about 8 carbon atoms;

$R_{11}$ is hydrogen or methyl;

k is an integer of from about 2 to about 6;

G represents the residue minus from 1 to e hydrogen atoms from the hydroxyl groups of an alcohol previously containing from 1 to about 200 hydroxyl groups; and L is an integer from about 1 to about 200. The term "about," as used herein in connection with one or more numbers or numerical ranges, should be understood to refer to all such numbers, including all numbers in a range.

In one embodiment, the composition of the invention includes about 35 to about 1 part oxa ester, based on 100 parts by weight of the composition. In another embodiment, the composition of the invention includes about 25 parts to about 1 part oxa ester, based on 100 parts by weight of the composition. In yet another embodiment, the oxa ester is included in the composition of the invention in about 15 parts to about 1 part, based on 100 parts by weight of the composition.

Oxa esters may be blended with other polymers or ionomers, according to methods well known in the art, to form compositions useful for forming golf balls. For example, oxa esters may be blended with saponified polymers to form saponified polymer/oxa ester blends, which be used alone or blended with thermoplastic ionomers, such as ethylene methacrylic acid ionomers and ethylene acrylic acid ionomers and their terpolymers, which are sold commercially under the trade names SURLYN® and IOTEK® by DuPont and Exxon respectively.

The terms "saponified polymer/oxa ester blend" and "saponified/oxa ester blend", as used herein, refers to any polymer blend that includes at least one saponified polymer and at least one oxa ester. As used herein with regard to a polymer blend, the term "compatible" refers to a blend of two or more polymers, having useful golf ball properties, that is homogeneous on a macroscopic scale. Compatible blends may be miscible (i.e., homogeneous on a microscopic scale), or at least partially immiscible (i.e., heterogeneous on a microscopic scale, but homogeneous on a macroscopic scale) and have a "reduced interfacial tension" at the polymer interface. The term "incompatible" refers to a mixture of at least two polymers that is heterogeneous on both a microscopic scale and a macroscopic scale, such that useful golf ball properties, such as durability, are lacking.

In the aspect of the invention involving saponified polymer/oxa ester blends, a saponified polymer with ionomeric character may first be blended with the other similar polymers, having a different metal base cation or distribution of cationic species than used to make the first saponified polymer, to yield a blend with desirable golf ball properties. Alternatively, two different saponified polymers with ionomeric character, having the same metal base cation can be blended to yield a useful blend. The two polymers can differ in their degree of hydrolysis, degree of subsequent acidification, molecular weight, molecular weight distribution, tacticity, blockiness, etc.

For example, the other polymers that can be used in conjunction with saponified polymer/oxa ester blends in golf ball covers include, but are not limited to: block copolymers of a poly(ether-ester), such as HYTREL® available from DuPont, block copolymers of a poly(ether-amide), such as PEBAX® available from Atofina, styrene-butadiene-styrene block copolymers, such as the KRATON D® grades available from Shell Chemical, styrene-(ethylene-propylene)-styrene or styrene-(ethylene-butylene)-styrene block copolymers, such as the KRATON G® series from Shell Chemical, either of the KRATON®s with maleic anhydride or sulfonic graft or functionality, such as the KRATON FD® or KRATON FG® series available from Shell Chemical, olefinic copolymers, such as the ethylene-acrylate or ethylene methacrylate series available from Quantum, metallocene catalyzed polymers, including ethylene-octene copolymers made from metallocene catalysts, such as those available as the AFFINITY® or ENGAGE® series from Dow, and ethylene-alpha olefin copolymers and terpolymers made from metallocene catalysts, available as the EXACT® series from Exxon, block poly(urethane-ester) or block poly(urethane-ether) or block poly(urethane-caprolactone), such as the ESTANE® series available from BF Goodrich, polyethylene glycol, such as CARBOWAX® available from Union Carbide, polycaprolactone, polycaprolactam, polyesters, such as EKTAR® available from Eastman, polyamides, such as nylon 6 or nylon 6,6, available from DuPont and ICI, ethylene-propylene-(diene monomer) terpolymers and their sulfonated or carboxylated derivatives, and PP/EPDM and dynamically vulcanized rubbers, such as SANTOPRENE® from Monsanto.

In one embodiment, the saponified polymer/oxa ester blend includes about 65 parts to about 99 parts of at least one saponified polymer and about 35 parts to about 1 part of at least one oxa ester, based on 100 parts by weight of the saponified polymer/oxa ester blend. In another embodiment, the saponified polymer/oxa ester blend includes about 75 parts to about 99 parts saponified polymer and about 25 parts to about 1 part oxa ester, based on 100 parts by weight of the saponified polymer/oxa ester blend. In still another embodiment, the saponified polymer/oxa ester blend includes about 85 parts to about 99 parts of at least one saponified polymer and about 15 parts to about 1 part of at least one oxa ester, based on 100 parts by weight of the saponified polymer/oxa ester blend.

The saponified polymer/oxa ester blends of the present invention can be prepared with or without the addition of a compatibilizer, and with varying molecular architecture of blend components, such as varying molecular weight, tacticity, degrees of blockiness, etc., as is well known to those knowledgeable in the art of blending polymers.

The amounts of polymers used to form saponified polymer/oxa ester blends can vary from about 1 to about 99 parts of the saponified polymer/oxa ester blend to about 99 to about 1 parts of other polymers or ionomers, based on the total weight of polymers. More preferred ratios of about 95 to about 5 parts of the saponified polymer/oxa ester blend with about 5 to about 95 parts of one or more other polymers. Most preferred is from about 95 parts to about 10 parts of the subject saponified polymer/oxa ester blends and from about 5 to about 90 parts of the other polymer or ionomer.

Blending of the saponified polymer/oxa ester blends is accomplished in a conventional manner using conventional equipment. Good results have been obtained by mixing the resins in a solid, pelletized form and then placing the mix into a hopper which i., used to feed the heated barrel of the injection molding machine. Further mixing is accomplished by a screw in the heated barrel. For golf ball covers, the injection molding machine may be used either to make preformed half-shells for compression molding about core or for molding flowable cover stock about a core using a retractable-pin mold. Similar techniques may be used to form golf ball cores and mantle or intermediate layers situated between a cover an a core with any of the compositions of the invention. Such machines and techniques are conventional.

Compositions including oxa esters may be blended with additional ingredients noted below, for example, to be used in a golf ball cover using any conventional blending technique. For example, the present compounds may be added to a vessel containing pelletized polymer resins and heated to 300 to 500° F. Thorough mixing of the materials is accomplished by means of a screw in the heated vessel.

Additives

The compositions of the invention described above may also include various additives. For example, fillers may be added to the compositions of the invention to affect rheological and mixing properties, the specific gravity, i.e., density-modifying fillers, the modulus, the tear strength, reinforcement, and the like. The fillers are generally inorganic, and suitable fillers include numerous metals, metal oxides and salts, such as zinc oxide and tin oxide, as well as barium sulfate, zinc sulfate, calcium oxide, calcium carbonate, zinc carbonate, barium carbonate, clay, tungsten, tungsten carbide, an array of silicas, regrind (recycled core material typically ground to about 30 mesh particle), high-Mooney-viscosity rubber regrind, and mixtures thereof.

In one embodiment, the compositions of the invention can be reinforced by blending with a wide range of density-adjusting fillers, e.g., ceramics, glass spheres (solid or hollow, and filled or unfilled), and fibers, inorganic particles, and metal particles, such as metal flakes, metallic powders, oxides, and derivatives thereof, as is known to those with skill in the art. The selection of such filler(s) is dependent upon the type of golf ball desired, i.e., one-piece, two-piece, multi-component, or wound, as will be more fully detailed below. In another embodiment, the filler will be inorganic, having a density of greater than 4 g/cc, and will be present in amounts between about 5 and about 65 weight percent based on the total weight of the polymer composition.

The compositions of the invention may also be foamed by the addition of the at least one physical or chemical blowing or foaming agent. The use of a foamed polymer allows the golf ball designer to adjust the density or mass distribution of the ball to adjust the angular moment of inertia, and, thus, the spin rate and performance of the ball. Foamed materials also offer a potential cost savings due to the reduced use of polymeric material. As used herein, the term "foamed" encompasses "conventional foamed" materials that have cells with an average diameter of greater than 100 microns and "microcellular" type materials that have closed cell sizes on the order of 2 to 25 microns. Examples of conventional foamed materials include those described in U.S. Pat. No. 4,274,637. Examples of microcellular closed cell foams include those foams disclosed in U.S. Pat. Nos. 4,473,665 and 5,160,674. In this embodiment, the polymer blend may be foamed during molding by any conventional foaming or blowing agent. Preferably, foamed layers incorporating an oxa ester or oxa ester blend have a flexural modulus of at least 1,000 to about 150,000 psi.

Blowing or foaming agents useful include, but are not limited to, organic blowing agents, such as azobisformamide; azobisisobutyronitrile; diazoaminobenzene; N,N-dimethyl-N,N-dinitroso terephthalamide; N,N-dinitrosopentamethylene-tetramine; benzenesulfonyl-hydrazide; benzene-1,3-disulfonyl hydrazide; diphenylsulfone-3,3'-disulfonyl hydrazide; 4,4'-oxybis benzene sulfonyl hydrazide; p-toluene sulfonyl semicarbizide; barium azodicarboxylate; butylamine nitrile; nitroureas; trihydrazino triazine; phenylmethyl-uranthan; p-sulfonhydrazide; peroxides; and inorganic blowing agents such as ammonium bicarbonate and sodium bicarbonate. A gas, such as air, nitrogen, carbon dioxide, etc., can also be injected into the composition during the injection molding process.

A foamed composition of the present invention may also be formed by blending microspheres with the composition either during or before the molding process. Polymeric, ceramic, metal, and glass microspheres are useful in the invention, and may be solid or hollow and filled or unfilled. In particular, microspheres up to about 1000 micrometers in diameter are useful. Generally, either injection molding or compression molding may be used to form a layer or a core including a foamed polymeric material.

Additional materials conventionally included in golf ball compositions may be added to the compositions of the invention. These additional materials include, but are not limited to, reaction enhancers, crosslinking agents, optical brighteners, coloring agents, fluorescent agents, whitening agents, UV absorbers, hindered amine light stabilizers, defoaming agents, processing aids, mica, talc, nano-fillers, and other conventional additives. Antioxidants, stabilizers, softening agents, fragrance components, plasticizers, including internal and external plasticizers, impact modifiers, foaming agents, excipients, reinforcing materials and compatibilizers can also be added to any composition of the invention. All of these materials, which are well known in the art, are added for their usual purpose in typical amounts.

Golf Ball Construction

The compositions of the invention described above are contemplated for use in golf balls of any construction, e.g., one-piece, two-piece, or three-piece design, a double core, a double cover, an intermediate layer(s), a multi-layer core, and/or a multi-layer cover, depending on the type of performance desired of the ball. As used herein, the term "multi-layer" means at least two layers. For example, the compositions of the invention may be used in a core, intermediate layer, and/or cover of a golf ball, each of which may have a single layer or multiple layers.

Thus, golf balls of the invention preferably include at least one foamed or unfoamed layer formed from a composition including at least one highly neutralized polymer, oxa ester, saponified polymer/oxa ester blends, saponified polymer, saponified polymer/oxa acid blend, grafted metallocene catalyzed polymers or polymer blends, non-grafted metallocene catalyzed polymers or polymer blends and metallocene catalyzed polymers or conventional materials, including balata and ionomer cover stock. As used herein, the term "layer" includes any generally spherical portion of a golf ball, i.e., a golf ball core or center, an intermediate layer, and/or a golf ball cover.

Oxa ester and saponified polymer/oxa ester blend cover layers according to the invention may be used with conventional solid or wound cores, as well as those including other core materials, such as those described above, including, but not limited to, oxa esters, saponified polymer/oxa ester blends, oxa acids, saponified polymers, saponified polymer/oxa acid blend, grafted and non-grafted metallocene catalyzed polymers and polymer blends. Preferably, the cover of a golf ball according to the invention is formed from a polymer blend including at least one oxa ester or saponified polymer/oxa ester blend.

The compositions of the invention may be used to form any type of golf ball. In particular, two-piece golf balls including a cover surrounding a core are within the scope of the present invention, as are wound golf balls, in which a fluid, semi-solid or solid core is surrounded by an elastic synthetic material. Any type of golf ball core can be used in the golf balls of the present invention. Preferred cores, however, include some amount of cis-polybutadiene. The subject polymers may also be used in golf balls having multiple covers and/or multiple cores.

Figure 2:
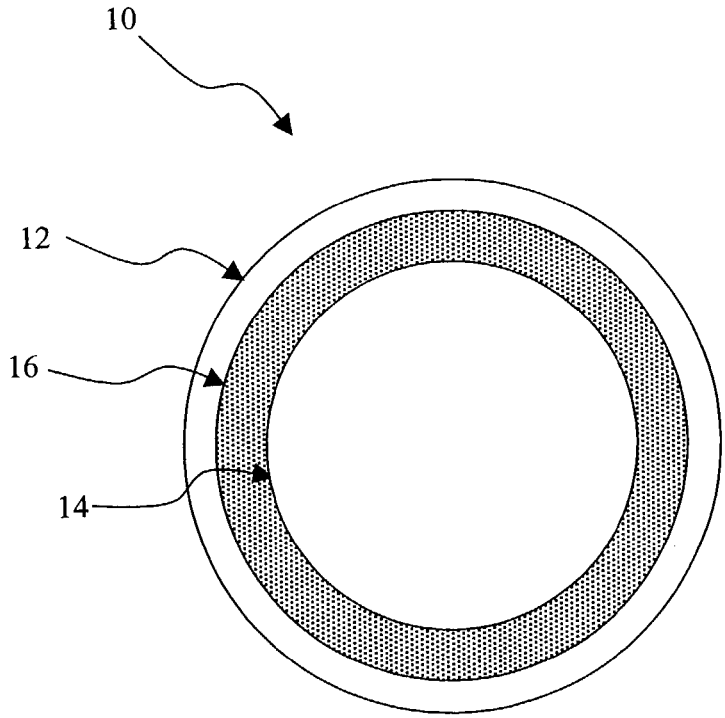
FIG. 2 is a cross-sectional view of a golf ball according to the invention incorporating a multi-layer core.

For example, FIG. 1 illustrates a golf ball according to the invention with a one-piece core. Golf ball 1 includes a core 2 and a cover 3, wherein at least one of core 2 and cover 3 incorporates at least one foamed or unfoamed layer including at least one composition of the invention described above, e.g., oxa ester composition, saponified polymer/oxa ester blend, oxa acid composition, oxa ester/oxa acid blend, saponified polymer/oxa acid blend, highly neutralized polymer composition, or a combination thereof. Similarly, FIG. 2 illustrates a golf ball according to the invention incorporating a multi-piece core. Golf ball 10 includes a cover 12, a core having a center 14 and at least one additional core layer 16. Any of the cover 12, center 14, or core layer 16 may incorporate at least one foamed or unfoamed layer that includes at least one composition of the invention.

Figure 3:
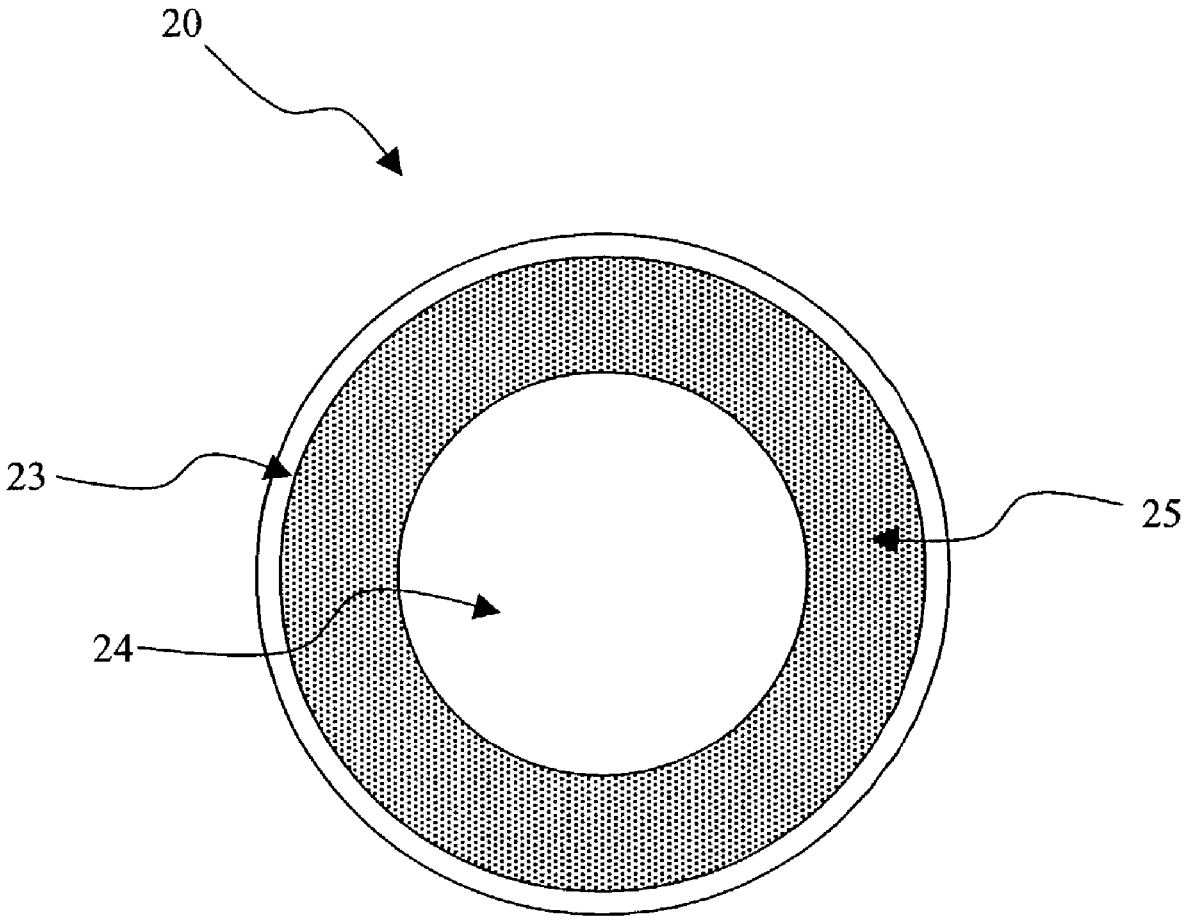
FIG. 3 is a cross-sectional view of a golf ball according to the invention incorporating a intermediate layer between the cover and the core.

A golf ball incorporating an intermediate layer is illustrated in FIG. 3, which depicts golf ball 20, having cover 23, core 24, and an intermediate layer 25 situated between the cover and the core. Any of cover 23, core 24, and intermediate layer 25 may incorporate at least one foamed or unfoamed layer including at least one oxa ester, oxa acid, saponified polymer/oxa ester blend, oxa ester/oxa acid blend, highly neutralized polymer, or a combination thereof. Core 24 may be a one-piece core, a multi-layer core, or a wound core, having a solid or fluid center formed from one or more of the materials described below.

Core Layer(s)

The present invention contemplates the use of the compositions of the invention in one-piece cores and one-piece balls. As used herein, the term "core" means the innermost portion of a golf ball, and may include one or more layers. When more than one layer is contemplated, the core includes a center and at least one outer core layer disposed thereabout. At least a portion of the core, typically the center, is solid, hollow, or fluid-filled. As used herein, the term "fluid" means a gas, liquid, gel, paste, or the like, or a combination thereof.

In one embodiment, the core of a golf ball of the invention includes oxa esters or saponified polymer/oxa ester blends. Alternatively, the cores of the present invention may also include rubber-based materials, such as compositions including a base rubber, a crosslinking agent, and a density adjusting filler. The base rubber may includes natural or synthetic rubbers. In one embodiment, core is formed of a polybutadiene reaction product as disclosed in co-pending U.S. patent application Ser. No. 10/190,705, filed Jul. 9, 2002, entitled "Low Compression, Resilient Golf Balls With Rubber Cores," which is incorporated in its entirety by reference herein. Crosslinking agents include metal salts of unsaturated fatty acids, such as zinc or magnesium salts of acrylic or methacrylic acid. The density adjusting filler typically includes materials such as zinc oxide, barium sulfate, silica, calcium carbonate, zinc carbonate and the like.

The core may also include one or more wound layers (surrounding a fluid or solid center) including at least one tensioned elastomeric material wound about the center. In one embodiment, the tensioned elastomeric material includes natural or a synthetic elastomers or blends thereof. The synthetic elastomer preferably includes LYCRA.

In another embodiment, the tensioned elastomeric material incorporates a polybutadiene reaction product as disclosed in co-pending U.S. patent application Ser. No. 10/190,705. In yet another embodiment, the tensioned elastomeric material may also be formed from conventional polyisoprene. In still another embodiment, a polyurea composition (as disclosed in co-pending U.S. patent application Ser. No. 10/228,311, filed Aug. 27, 2002, entitled "Golf Balls Comprising Light Stable Materials and Methods for Making Same," which is incorporated by reference in its entirety by reference herein) is used to form the tensioned elastomeric material,. In another embodiment, solvent spun polyether urea, as disclosed in U.S. Pat. No. 6,149,535, which is incorporated in its entirety by reference herein, is used to form the tensioned elastomeric material in an effort to achieve a smaller cross-sectional area with multiple strands.

The tensioned elastomeric layer may also be a high tensile filament having a tensile modulus of about 10,000 kpsi or greater, as disclosed in co-pending U.S. patent application Ser. No. 09/842,829, filed Apr. 27, 2001, entitled "All Rubber Golf Ball with Hoop-Stress Layer," the entire disclosure of which is incorporated by reference herein. In another embodiment, the tensioned elastomeric layer is coated with a binding material that will adhere to the core and itself when activated, causing the strands of the tensioned elastomeric layer to swell and increase the cross-sectional area of the layer by at least about 5 percent. An example of such a golf ball construction is provided in co-pending U.S. patent application Ser. No. 09/841,910, the entire disclosure of which is incorporated by reference herein.

Intermediate Layer(s)

The present invention also contemplates the use of the compositions of the invention described above in intermediate layers. An intermediate layer" (also known as inner layer or mantle layer) is defined herein as a portion of the golf ball that occupies a volume between the cover and the core. Such an intermediate layer may be distinguished from a cover or a core by some difference between the golf ball layers, e.g., hardness, compression, thickness, and the like. An intermediate layer may be used, if desired, with a multilayer cover or a multilayer core, or with both a multilayer cover and a multilayer core. Therefore, an intermediate layer is also sometimes referred to in the art as an inner cover layer, an outer core layer, or a mantle layer.

In one embodiment, the intermediate layer includes at least one at least one oxa ester, conventional ionomer, oxa acid, saponified polymer/oxa acid blend, saponified polymer/oxa ester blend, highly neutralized polymer, or other polymer blend, such as those formed from a grafted or non-grafted metallocene catalyzed polymer or polymer blend, or from any other suitable polymeric material having the desired properties, including, but not limited to, block copolymers of a poly(ether-ester), such as HYTREL®, available from DuPont, block copolymers of a poly(ether-amide), such as PEBAX®, available from Elf Atochem, styrene-butadiene-styrene and styrene-(ethylene-propylene)-styrene or styrene-(ethylene-butylene)-styrene block copolymers, and their functionalized derivatives, such as KRATON D®, KRATON G®, and KRATON FG® from Shell Chemical. The layer formed from a composition of the invention preferably has a thickness of at least about 0.005 inch to about 0.125 inch and a hardness of about 15 Shore D to about 80 Shore D.

The intermediate layer may also be formed of a binding material and an interstitial material distributed in the binding material, as discussed in U.S patent application Ser. No. 10/028,826, filed Dec. 28, 2001, entitled, "Golf Ball with a Radially Oriented Transversely Isotropic Layer and Manufacture of Same," the entire disclosure of which is incorporated by reference herein. In addition, at least one intermediate layer may also be a moisture barrier layer, such as the ones described in U.S. Pat. No. 5,820,488, which is incorporated in its entirety by reference herein. The intermediate layer may also be formed from any of the polyurethane, polyurea, and polybutadiene materials discussed co-pending U.S. patent application Ser. No. 10/228,311.

The intermediate layer may also likewise include one or more homopolymeric or copolymeric materials, such as:

(1) Vinyl resins, such as those formed by the polymerization of vinyl chloride, or by the copolymerization of vinyl chloride with vinyl acetate, acrylic esters or vinylidene chloride;

(2) Polyolefins, such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using a single-site catalyst or a metallocene catalyst;

(3) Polyurethanes, such as those prepared from polyols and diisocyanates or polyisocyanates and those disclosed in U.S. Pat. No. 5,334,673;

(4) Polyureas, such as those disclosed in U.S. Pat. No. 5,484,870;

(5) Polyamides, such as poly(hexamethylene adipamide) and others prepared from diamines and dibasic acids, as well as those from amino acids such as poly(caprolactam), and blends of polyamides with SURLYN, polyethylene, ethylene copolymers, ethyl-propylene-non-conjugated diene terpolymer, and the like;

(6) Acrylic resins and blends of these resins with poly vinyl chloride, elastomers, and the like;

(7) Thermoplastics, such as urethanes; olefinic thermoplastic rubbers, such as blends of polyolefins with ethylene-propylene-non-conjugated diene terpolymer; block copolymers of styrene and butadiene, isoprene or ethylene-butylene rubber; or copoly(ether-amide), such as PEBAX, sold by ELF Atochem of Philadelphia, Pa.;

(8) Polyphenylene oxide resins or blends of polyphenylene oxide with high impact polystyrene as sold under the trademark NORYL by General Electric Company of Pittsfield, Mass.;

(9) Thermoplastic polyesters, such as polyethylene terephthalate, polybutylene terephthalate, polyethylene terephthalate/glycol modified and elastomers sold under the trademarks HYTREL by E.I. DuPont de Nemours & Co. of Wilmington, Del., and LOMOD by General Electric Company of Pittsfield, Mass.;

(10) Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and

(11) Blends of thermoplastic rubbers with polyethylene, propylene, polyacetal, nylon, polyesters, cellulose esters, and the like.

In one embodiment, the intermediate layer includes polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly (phenylene sulfide), acrylonitrile-butadiene, acrylic-styrene-acrylonitrile, poly(ethylene terephthalate), poly(butylene terephthalate), poly(ethelyne vinyl alcohol), poly(tetrafluoroethylene) and their copolymers including functional comonomers, and blends thereof.

As briefly mentioned above, the intermediate layer may include ionomeric materials, such as ionic copolymers of ethylene and an unsaturated monocarboxylic acid, which are available under the trademark SURLYN® of E.I. DuPont de Nemours & Co., of Wilmington, Del., or IOTEK® or ESCOR® of Exxon. These are copolymers or terpolymers of ethylene and methacrylic acid or acrylic acid totally or partially neutralized, i.e., from about 1 to about 100 percent, with salts of zinc, sodium, lithium, magnesium, potassium, calcium, manganese, nickel or the like. In one embodiment, the carboxylic acid groups are neutralized from about 10 percent to about 100 percent. The carboxylic acid groups may also include methacrylic, crotonic, maleic, fumaric or itaconic acid. The salts are the reaction product of an olefin having from 2 to 10 carbon atoms and an unsaturated monocarboxylic acid having 3 to 8 carbon atoms.

The intermediate layer may also include at least one ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. The ionomer also may include so-called "low acid" and "high acid" ionomers, as well as blends thereof. In general, ionic copolymers including up to about 15 percent acid are considered "low acid" ionomers, while those including greater than about 15 percent acid are considered "high acid" ionomers.

The ionomer compositions may also include at least one grafted metallocene catalyzed polymers. In addition, ionomers may be blended with non-ionomeric thermoplastic materials or non-ionomeric thermoplastic materials may be used unincorporated into an ionomer blend. Examples of such non-ionomeric thermoplastic materials include, but are not limited to, polyamides and polyamide blends, grafted and non-grafted metallocene catalyzed polyolefins or polyamides, polyamide/ionomer blends, polyamide/nonionomer blends, polyphenylene ether/ionomer blends, and mixtures thereof. Examples of grafted and non-grafted metallocene catalyzed polyolefins or polyamides, polyamide/ionomer blends, polyamide/nonionomer blends are disclosed in co-pending U.S. patent application Ser. No. 10/138,304, filed May 6, 2002, entitled "Golf Ball Incorporating Grafted Metallocene Catalyzed Polymer Blends," the entire disclosure of which is incorporated by reference herein. In one embodiment, the non-ionomeric materials have a hardness of about 60 Shore D or greater and a flexural modulus of about 30,000 psi or greater.

Additional materials may be included in the intermediate layer compositions outlined above. For example, catalysts, coloring agents, optical brighteners, crosslinking agents, whitening agents such as $TiO_2$ and ZnO, UV absorbers, hindered amine light stabilizers, defoaming agents, processing aids, surfactants, and other conventional additives may be added to the intermediate layer compositions of the invention. In addition, antioxidants, stabilizers, softening agents, plasticizers, including internal and external plasticizers, impact modifiers, foaming agents, density-adjusting fillers, reinforcing materials, and compatibilizers may also be added to any of the intermediate layer compositions. One of ordinary skill in the art should be aware of the requisite amount for each type of additive to realize the benefits of that particular additive.

Prior to forming the cover layer, the inner ball, i.e., the core and any intermediate layers disposed thereon, may be surface treated to increase the adhesion between the outer surface of the inner ball and the cover. Examples of such surface treatment may include mechanically or chemically abrading the outer surface of the subassembly. Additionally, the inner ball may be subjected to corona discharge or plasma treatment prior to forming the cover around it. Other layers of the ball, e.g., the core, also may be surface treated. Examples of these and other surface treatment techniques can be found in U.S. Pat. No. 6,315,915, which is incorporated by reference in its entirety.

Cover Layer(s)

The cover provides the interface between the ball and a club. As used herein, the term "cover" means the outermost portion of a golf ball. A cover typically includes at least one layer and may contain indentations such as dimples and/or ridges. Paints and/or laminates are typically disposed about the cover to protect the golf ball during use thereof. The cover may include a plurality of layers, e.g., an inner cover layer disposed about a golf ball center and an outer cover layer formed thereon.

The cover layers of the invention may be used with conventional solid or wound cores, as well as those cores including the compositions of the invention. In addition, cover layers formed from the compositions of the invention may be used in a golf balls having at least one intermediate layer formed from conventional materials or formed from the compositions of the invention. Likewise, the cover may include a plurality of layers, e.g., an inner cover layer disposed about a golf ball center (and optionally an at least one intermediate layer) and an outer cover layer formed thereon.

Properties that are desirable for the cover are good moldability, high abrasion resistance, high tear strength, high resilience, and good mold release, among others.

Thus, golf balls of the invention may include at least one foamed or unfoamed cover layer formed from a composition including at least one highly neutralized polymer, oxa ester, saponified polymer/oxa ester blends, saponified polymer, saponified polymer/oxa acid blend, grafted metallocene catalyzed polymers or polymer blends, non-grafted metallocene catalyzed polymers or polymer blends and metallocene catalyzed polymers or conventional materials, including balata and ionomer cover stock. The layer formed from a composition of the invention preferably has a thickness of at least about 0.005 inch to about 0.125 inch and a hardness of about 15 Shore D to about 80 Shore D.

Golf balls according to the invention may also be formed having a cover of polyurethane, polyurea, and polybutadiene materials discussed co-pending U.S. patent application Ser. No. 10/228,311. In addition, cover layers may also be formed of one or more homopolymeric or copolymeric materials, such as vinyl resins, polyolefins, polyamides, acrylic resins and blends of these resins with poly vinyl chloride, elastomers, and the like, thermoplastic urethanes, olefinic thermplastic rubbers, block copolymers of styrene and butadiene, polyphenylene oxide resins or blends of polyphenylene oxide with high impact polystyrene, thermoplastic polyesters, ethylene, propylene, 1-butene or 1-hexane based homopolymers or copolymers including functional monomers, methyl acrylate, methyl methacrylate homopolymers and copolymers, low acid ionomers, high acid ionomers, alloys, and mixtures thereof. The cover may also be at least partially formed from the polybutadiene reaction product discussed above with respect to the core.

In addition, while hardness gradients are typically used in a golf ball to achieve certain characteristics, the present invention also contemplates the compositions of the invention being used in a golf ball with multiple cover layers having essentially the same hardness, wherein at least one of the layers has been modified in some way to alter a property that affects the performance of the ball. Such ball constructions are disclosed in co-pending U.S. patent application Ser. No. 10/167,744, filed Jun. 13, 2002, entitled "Golf Ball with Multiple Cover Layers," the entire disclosure of which is incorporated by reference herein. Both covers layers can be formed of the same material and have essentially the same hardness, but the layers are designed to have different coefficient of friction values, different rheological properties under high deformation, different thicknesses to simulate a soft outer cover over hard inner cover ball, among others differences described in U.S. patent application Ser. No. 10/167,744.

Other non-limiting examples of suitable types of ball constructions that may be used with the present invention include those described in U.S. Pat. Nos. 6,056,842, 5,688,191, 5,713,801, 5,803,831, 5,885,172, 5,919,100, 5,965,669, 5,981,654, 5,981,658, and 6,149,535, as well as in Publication Nos. US2001/0009310 A1, US2002/0025862, and US2002/0028885. The entire disclosures of these patents and published patent applications are incorporated by reference herein.

As discussed elsewhere herein, the composition may be molded onto the golf ball in any known manner, such as by casting, compression molding, injection molding, reaction injection molding, or the like. One skilled in the art would appreciate that the molding method used may be determined at least partially by the properties of the composition. For example, casting may be preferred when the material is thermoset, whereas compression molding or injection molding may be preferred for thermoplastic compositions.

Methods for Forming

The golf balls of the invention may be formed using a variety of application techniques such as compression molding, flip molding, injection molding, retractable pin injection molding, reaction injection molding (RIM), liquid injection molding (LIM), casting, vacuum forming, powder coating, flow coating, casting, spin coating, dipping, spraying, and the like. A method of injection molding using a split vent pin can be found in co-pending U.S. patent application Ser. No. 09/742,435, filed Dec. 22, 2000, entitled "Split Vent Pin for Injection Molding." Examples of retractable pin injection molding may be found in U.S. Pat. Nos. 6,129,881, 6,235,230, and 6,379,138. These molding references are incorporated in their entirety by reference herein. In addition, a chilled chamber, i.e., a cooling jacket, such as the one disclosed in U.S. patent application Ser. No. 09/717,136, filed Nov. 22, 2000, entitled "Method of Making Golf Balls" may be used to cool the compositions of the invention when casting, which also allows for a higher loading of catalyst into the system.

Conventionally, compression molding and injection molding are applied to thermoplastic materials, whereas RIM, LIM, and casting may be employed on thermoset cover materials. However, compression molding may also be used for thermoset inner ball materials. For example, when cores are formed from a thermoset material, compression molding is a particularly suitable method of forming the core, whereas when the cores are formed of a thermoplastic material, the cores may be injection molded. In addition, the intermediate layer may also be formed from using any suitable method known to those of ordinary skill in the art. For example, an intermediate layer may be formed by blow molding and covered with a dimpled cover layer formed by injection molding, compression molding, casting, vacuum forming, powder coating, and the like.

In addition, when covers are formed of polyurethane and polyurea compositions of the invention may be applied over an inner ball using a variety of application techniques such as spraying, compression molding, dipping, spin coating, or flow coating methods that are well known in the art.

In one embodiment, the polyurethane or polyurea composition is used to form a cover over the core using a combination of casting and compression molding. U.S. Pat. No. 5,733,428, the entire disclosure of which is hereby incorporated by reference, discloses a useful method for forming a polyurethane cover on a golf ball core. Similarly, U.S. Pat. Nos. 5,006,297 and 5,334,673 both also disclose suitable molding techniques that may be utilized to apply the castable reactive liquids employed in the present invention. However, the method of the invention is not limited to the use of these techniques; other methods known to those skilled in the art may also be employed. For instance, other methods for holding the ball core may be utilized instead of using a partial vacuum.

The methods discussed herein and other manufacturing methods for forming the golf ball components of the present invention are disclosed in U.S. Pat. Nos. 6,207,784 and 5,484,870, the disclosures of which are incorporated herein by reference in their entirety. Furthermore, U.S. Pat. Nos. 6,180,040 and 6,180,722 disclose methods of preparing dual core golf balls. The disclosures of these patents are hereby incorporated by reference in their entirety.

Dimples

The use of various dimple patterns and profiles provides a relatively effective way to modify the aerodynamic characteristics of a golf ball. As such, the manner in which the dimples are arranged on the surface of the ball can be by any available method. For instance, the ball may have an icosahedron-based pattern, such as described in U.S. Pat. No. 4,560,168, or an octahedral-based dimple patterns as described in U.S. Pat. No. 4,960,281. Alternatively, the dimple pattern can be arranged according to phyllotactic patterns, such as described in U.S. Pat. No. 6,338,684, which is incorporated herein in its entirety.

Dimple patterns may also be based on Archimedean patterns including a truncated octahedron, a great rhombcuboctahedron, a truncated dodecahedron, and a great rhombicosidodecahedron, wherein the pattern has a non-linear parting line, as disclosed in U.S. patent application Ser. No. 10/078,417, which is incorporated by reference herein. The golf balls of the present invention may also be covered with non-circular shaped dimples, i.e., amorphous shaped dimples, as disclosed in U.S. Pat. No. 6,409,615, which is incorporated in its entirety by reference herein.

Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. In one embodiment, the golf balls of the invention have a dimple coverage of the surface area of the cover of at least about 60 percent, preferably at least about 65 percent, and more preferably at least 70 percent or greater. Dimple patterns having even higher dimple coverage values may also be used with the present invention. Thus, the golf balls of the present invention may have a dimple coverage of at least about 75 percent or greater, about 80 percent or greater, or even about 85 percent or greater.

In addition, a tubular lattice pattern, such as the one disclosed in U.S. Pat. No. 6,290,615, which is incorporated by reference in its entirety herein, may also be used with golf balls of the present invention. The golf balls of the present invention may also have a plurality of pyramidal projections disposed on the intermediate layer of the ball, as disclosed in U.S. Pat. No. 6,383,092, which is incorporated in its entirety by reference herein. The plurality of pyramidal projections on the golf ball may cover between about 20 percent to about 80 of the surface of the intermediate layer.

In an alternative embodiment, the golf ball may have a non-planar parting line allowing for some of the plurality of pyramidal projections to be disposed about the equator. Such a golf ball may be fabricated using a mold as disclosed in co-pending U.S. patent application Ser. No. 09/442,845, filed Nov. 18, 1999, entitled "Mold For A Golf Ball," and which is incorporated in its entirety by reference herein. This embodiment allows for greater uniformity of the pyramidal projections.

Several additional non-limiting examples of dimple patterns with varying sizes of dimples are also provided in U.S. patent application Ser. No. 09/404,164, filed Sep. 27, 1999, entitled "Golf Ball Dimple Patterns," and U.S. Pat. No. 6,213,898, the entire disclosures of which are incorporated by reference herein.

The total number of dimples on the ball, or dimple count, may vary depending such factors as the sizes of the dimples and the pattern selected. In general, the total number of dimples on the ball preferably is between about 100 to about 1000 dimples, although one skilled in the art would recognize that differing dimple counts within this range can significantly alter the flight performance of the ball. In one embodiment, the dimple count is about 380 dimples or greater, but more preferably is about 400 dimples or greater, and even more preferably is about 420 dimples or greater. In one embodiment, the dimple count on the ball is about 422 dimples. In some cases, it may be desirable to have fewer dimples on the ball. Thus, one embodiment of the present invention has a dimple count of about 380 dimples or less, and more preferably is about 350 dimples or less.

Dimple profiles revolving a catenary curve about its symmetrical axis may increase aerodynamic efficiency, provide a convenient way to alter the dimples to adjust ball performance without changing the dimple pattern, and result in uniformly increased flight distance for golfers of all swing speeds. Thus, catenary curve dimple profiles, as disclosed in U.S. patent application Ser. No. 09/989,191, filed Nov. 21, 2001, entitled "Golf Ball Dimples with a Catenary Curve Profile," which is incorporated in its entirety by reference herein, is contemplated for use with the golf balls of the present invention.

Golf Ball Post-Processing

The golf balls of the present invention may be painted, coated, or surface treated for further benefits. For example, golf balls covers frequently contain a fluorescent material and/or a dye or pigment to achieve the desired color characteristics. A golf ball of the invention may also be treated with a base resin paint composition. In addition, the golf ball may be coated with a composition including a whitening agent. For example, U.S. Patent Publication No. 2002/0082358, which is incorporated by reference herein in its entirety, uses a derivative of 7-triazinylamino-3-phenylcoumarin as a fluorescent whitening agent to provide improved weather resistance and brightness.

In one embodiment, the golf balls of the invention may be UV cured. Suitable methods for UV curing are disclosed in U.S. Pat. Nos. 6,500,495, 6,248,804, and 6,099,415, the entire disclosures of which are incorporated by reference herein. In one embodiment, the top coat is UV curable. In another embodiment, the ink is UV curable and may be used as a paint layer or as a discrete marking tool for logos and indicias.

In addition, trademarks or other indicia may be stamped, i.e., pad-printed, on the outer surface of the ball cover, and the stamped outer surface is then treated with at least one clear coat to give the ball a glossy finish and protect the indicia stamped on the cover.

The golf balls of the invention may also be subjected to dye sublimation, wherein at least one golf ball component is subjected to at least one sublimating ink that migrates at a depth into the outer surface and forms an indicia. The at least one sublimating ink preferably includes at least one of an azo dye, a nitroarylamine dye, or an anthraquinone dye. U.S. patent application Ser. No. 10/012,538, filed Dec. 12, 2001, entitled, "Method of Forming Indicia on a Golf Ball," the entire disclosure of which is incorporated by reference herein.

Laser marking of a selected surface portion of a golf ball causing the laser light-irradiated portion to change color is also contemplated for use with the present invention. U.S. Pat. Nos. 5,248,878 and 6,075,223 generally disclose such methods, the entire disclosures of which are incorporated by reference herein. In addition, the golf balls may be subjected to ablation, i.e., directing a beam of laser radiation onto a portion of the cover, irradiating the cover portion, wherein the irradiated cover portion is ablated to form a detectable mark, wherein no significant discoloration of the cover portion results therefrom. Ablation is discussed in U.S. patent application Ser. No. 09/739,469, filed Dec. 18, 2002, entitled "Laser Marking of Golf Balls," which is incorporated in its entirety by reference herein.

Protective and decorative coating materials, as well as methods of applying such materials to the surface of a golf ball cover are well known in the golf ball art. Generally, such coating materials comprise urethanes, urethane hybrids, epoxies, polyesters and acrylics. If desired, more than one coating layer can be used. The coating layer(s) may be applied by any suitable method known to those of ordinary skill in the art. In one embodiment, the coating layer(s) is applied to the golf ball cover by an in-mold coating process, such as described in U.S. Pat. No. 5,849,168, which is incorporated in its entirety by reference herein.

Golf Ball Properties

The present invention can be used in forming golf balls of any desired size. While "The Rules of Golf" by the USGA dictates that the size of a competition golf ball be more than 1.680 inches in diameter, golf balls of any size can be used for leisure golf play. Therefore, while the preferred diameter of the golf balls is at least 1.680 inches to about 1.800 inches, golf balls of any size.

The properties such as hardness, modulus, core diameter, intermediate layer thickness and cover layer thickness of the golf balls of the present invention have been found to effect play characteristics such as spin, initial velocity and feel of the present golf balls. For example, the flexural and/or tensile modulus of the intermediate layer are believed to have an effect on the "feel" of the golf balls of the present invention.

Component Dimensions

Dimensions of golf ball components, i.e., thickness and diameter, may vary depending on the desired properties. For the purposes of the invention, any layer thickness may be employed. Non-limiting examples of the various embodiments outlined above are provided here with respect to layer dimensions.

The present invention relates to golf balls of any size. While USGA specifications limit the size of a competition golf ball to more than 1.68 inches in diameter, golf balls of any size can be used for leisure golf play. The preferred diameter of the golf balls is from about 1.68 inches to about 1.8 inches. The more preferred diameter is from about 1.68 inches to about 1.76 inches. A diameter of from about 1.68 inches to about 1.74 inches is most preferred, however diameters anywhere in the range of from 1.7 to about 1.95 inches can be used. Preferably, the overall diameter of the core and all intermediate layers is about 80 percent to about 98 percent of the overall diameter of the finished ball.

The core may have a diameter ranging from about 0.09 inches to about 1.65 inches. In one embodiment, the diameter of the core of the present invention is about 1.2 inches to about 1.630 inches. In another embodiment, the diameter of the core is about 1.3 inches to about 1.6 inches, preferably from about 1.39 inches to about 1.6 inches, and more preferably from about 1.5 inches to about 1.6 inches. In yet another embodiment, the core has a diameter of about 1.55 inches to about 1.65 inches.

The core of the golf ball may also be extremely large in relation to the rest of the ball. For example, in one embodiment, the core makes up about 90 percent to about 98 percent of the ball, preferably about 94 percent to about 96 percent of the ball. In this embodiment, the diameter of the core is preferably about 1.54 inches or greater, preferably about 1.55 inches or greater. In one embodiment, the core diameter is about 1.59 inches or greater. In another embodiment, the diameter of the core is about 1.64 inches or less.

When the core includes an inner core layer and an outer core layer, the inner core layer is preferably about 0.9 inches or greater and the outer core layer preferably has a thickness of about 0.1 inches or greater. In one embodiment, the inner core layer has a diameter from about 0.09 inches to about 1.2 inches and the outer core layer has a thickness from about 0.1 inches to about 0.8 inches. In yet another embodiment, the inner core layer diameter is from about 0.095 inches to about 1.1 inches and the outer core layer has a thickness of about 0.20 inches to about 0.03 inches.

The cover typically has a thickness to provide sufficient strength, good performance characteristics, and durability. In one embodiment, the cover thickness is from about 0.02 inches to about 0.35 inches. The cover preferably has a thickness of about 0.02 inches to about 0.12 inches, preferably about 0.1 inches or less. When the compositions of the invention are used to form the outer cover of a golf ball, the cover may have a thickness of about 0.1 inches or less, preferably about 0.07 inches or less. In one embodiment, the outer cover has a thickness from about 0.02 inches to about 0.07 inches. In another embodiment, the cover thickness is about 0.05 inches or less, preferably from about 0.02 inches to about 0.05 inches. In yet another embodiment, the outer cover layer of such a golf ball is between about 0.02 inches and about 0.045 inches. In still another embodiment, the outer cover layer is about 0.025 to about 0.04 inches thick. In one embodiment, the outer cover layer is about 0.03 inches thick.

The range of thicknesses for an intermediate layer of a golf ball is large because of the vast possibilities when using an intermediate layer, i.e., as an outer core layer, an inner cover layer, a wound layer, a moisture/vapor barrier layer. When used in a golf ball of the invention, the intermediate layer, or inner cover layer, may have a thickness about 0.3 inches or less. In one embodiment, the thickness of the intermediate layer is from about 0.002 inches to about 0.1 inches, preferably about 0.01 inches or greater. In one embodiment, the thickness of the intermediate layer is about 0.09 inches or less, preferably about 0.06 inches or less. In another embodiment, the intermediate layer thickness is about 0.05 inches or less, more preferably about 0.01 inches to about 0.045 inches. In one embodiment, the intermediate layer, thickness is about 0.02 inches to about 0.04 inches. In another embodiment, the intermediate layer thickness is from about 0.025 inches to about 0.035 inches. In yet another embodiment, the thickness of the intermediate layer is about 0.035 inches thick. In still another embodiment, the inner cover layer is from about 0.03 inches to about 0.035 inches thick. Varying combinations of these ranges of thickness for the intermediate and outer cover layers may be used in combination with other embodiments described herein.

The ratio of the thickness of the intermediate layer to the outer cover layer is preferably about 10 or less, preferably from about 3 or less. In another embodiment, the ratio of the thickness of the intermediate layer to the outer cover layer is about 1 or less. The core and intermediate layer(s) together form an inner ball preferably having a diameter of about 1.48 inches or greater for a 1.68-inch ball. In one embodiment, the inner ball of a 1.68-inch ball has a diameter of about 1.52 inches or greater. In another embodiment, the inner ball of a 1.68-inch ball has a diameter of about 1.66 inches or less. In yet another embodiment, a 1.72-inch (or more) ball has an inner ball diameter of about 1.50 inches or greater. In still another embodiment, the diameter of the inner ball for a 1.72-inch ball is about 1.70 inches or less.

Hardness

Most golf balls consist of layers having different hardnesses, e.g., hardness gradients, to achieve desired performance characteristics. The present invention contemplates golf balls having hardness gradients between layers, as well as those golf balls with layers having the same hardness.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

The cores of the present invention may have varying hardnesses depending on the particular golf ball construction. In one embodiment, the core hardness is at least about 15 Shore A, preferably about 30 Shore A, as measured on a formed sphere. In another embodiment, the core has a hardness of about 50 Shore A to about 90 Shore D. In yet another embodiment, the hardness of the core is about 80 Shore D or less. Preferably, the core has a hardness about 30 to about 65 Shore D, and more preferably, the core has a hardness about 35 to about 60 Shore D.

When a polybutadiene reaction product is incorporated into a core, the core may have a hardness gradient, i.e., a first hardness at a first point, i.e., at an interior location, and a second hardness at a second point, i.e., at an exterior surface, as measured on a molded sphere. In one embodiment, the second hardness is at least about 6 percent greater than the first hardness, preferably about 10 percent greater than the first hardness. In other embodiments, the second hardness is at least about 20 percent greater or at least about 30 percent greater, than the first hardness.

For example, the interior of the core may have a first hardness of about 45 Shore C to about 60 Shore C and the exterior surface of the core may have a second hardness of about 65 Shore C to about 75 Shore C. In one golf ball formulated according to the invention, the first hardness was about 51 Shore C and a second hardness was about 71 Shore C, providing a hardness difference of greater than 20 percent.

In one embodiment, however, the core has a substantially uniform hardness throughout. Thus, in this aspect, the first and second hardness preferably differ by about 5 percent or less, more preferably about 3 percent or less, and even more preferably by about 2 percent or less. In another embodiment, the hardness is uniform throughout the component.

The intermediate layer(s) of the present invention may also vary in hardness depending on the specific construction of the ball. In one embodiment, the hardness of the intermediate layer is about 30 Shore D or greater. In another embodiment, the hardness of the intermediate layer is about 90 Shore D or less, preferably about 80 Shore D or less, and more preferably about 70 Shore D or less. In yet another embodiment, the hardness of the intermediate layer is about 50 Shore D or greater, preferably about 55 Shore D or greater. In one embodiment, the intermediate layer hardness is from about 55 Shore D to about 65 Shore D. The intermediate layer may also be about 65 Shore D or greater.

When the intermediate layer is intended to be harder than the core layer, the ratio of the intermediate layer hardness to the core hardness preferably about 2 or less. In one embodiment, the ratio is about 1.8 or less. In yet another embodiment, the ratio is about 1.3 or less.

As with the core and intermediate layers, the cover hardness may vary depending on the construction and desired characteristics of the golf ball. The ratio of cover hardness to inner ball hardness is a primary variable used to control the aerodynamics of a ball and, in particular, the spin of a ball. In general, the harder the inner ball, the greater the driver spin and the softer the cover, the greater the driver spin.

For example, when the intermediate layer is intended to be the hardest point in the ball, e.g., about 50 Shore D to about 75 Shore D, the cover material may have a hardness of about 20 Shore D or greater, preferably about 25 Shore D or greater, and more preferably about 30 Shore D or greater, as measured on the slab. In another embodiment, the cover itself has a hardness of about 30 Shore D or greater. In particular, the cover may be from about 30 Shore D to about 60 Shore D. In one embodiment, the cover has a hardness of about 40 Shore D to about 65 Shore D. In another embodiment, the cover has a hardness less than about 45 Shore D, preferably less than about 40 Shore D, and more preferably about 25 Shore D to about 40 Shore D. In one embodiment, the cover has a hardness from about 30 Shore D to about 40 Shore D.

In this embodiment when the outer cover layer is softer than the intermediate layer or inner cover layer, the ratio of the Shore D hardness of the outer cover material to the intermediate layer material is about 0.8 or less, preferably about 0.75 or less, and more preferably about 0.7 or less. In another embodiment, the ratio is about 0.5 or less, preferably about 0.45 or less.

In yet another embodiment, the ratio is about 0.1 or less when the cover and intermediate layer materials have hardnesses that are substantially the same. When the hardness differential between the cover layer and the intermediate layer is not intended to be as significant, the cover may have a hardness of about 55 Shore D to about 65 Shore D. In this embodiment, the ratio of the Shore D hardness of the outer cover to the intermediate layer is about 1.0 or less, preferably about 0.9 or less.

The cover hardness may also be defined in terms of Shore C. For example, the cover may have a hardness of about 70 Shore C or greater, preferably about 80 Shore C or greater. In another embodiment, the cover has a hardness of about 95 Shore C or less, preferably about 90 Shore C or less.

In another embodiment, the cover layer is harder than the intermediate layer. In this design, the ratio of Shore D hardness of the cover layer to the intermediate layer is about 1.33 or less, preferably from about 1.14 or less.

When a two-piece ball is constructed, the core may be softer than the outer cover. For example, the core hardness may range from about 30 Shore D to about 50 Shore D, and the cover hardness may be from about 50 Shore D to about 80 Shore D. In this type of construction, the ratio between the cover hardness and the core hardness is preferably about 1.75 or less. In another embodiment, the ratio is about 1.55 or less. Depending on the materials, for example, if a composition of the invention is acid-functionalized wherein the acid groups are at least partially neutralized, the hardness ratio of the cover to core is preferably about 1.25 or less.

Compression

Compression values are dependent on the diameter of the component being measured. The Atti compression of the core, or portion of the core, of golf balls prepared according to the invention is preferably less than about 80, more preferably less than about 75. As used herein, the terms "Atti compression" or "compression" are defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. In another embodiment, the core compression is from about 40 to about 80, preferably from about 50 to about 70. In yet another embodiment, the core compression is preferably below about 50, and more preferably below about 25. are within the scope of the present invention.

In an alternative, low compression embodiment, the core has a compression less than about 20, more preferably less than about 10, and most preferably, 0. As known to those of ordinary skill in the art, however, the cores generated according to the present invention may be below the measurement of the Atti Compression Gauge. In an embodiment where the core is hard, the compression may be about 90 or greater. In one embodiment, the compression of the hard core ranges from about 90 to about 100.

In one embodiment, golf balls of the invention preferably have an Atti compression of about 55 or greater, preferably from about 60 to about 120. In another embodiment, the Atti compression of the golf balls of the invention is at least about 40, preferably from about 50 to 120, and more preferably from about 60 to 100. In yet another embodiment, the compression of the golf balls of the invention is about 75 or greater and about 95 or less. For example, a preferred golf ball of the invention may have a compression from about 80 to about 95.

Initial Velocity and COR

As used herein, the term "coefficient of restitution" (COR) is calculated by dividing the rebound velocity of the golf ball by the incoming velocity when a golf ball is shot out of an air cannon. The COR testing is conducted over a range of incoming velocities and determined at an inbound velocity of 125 ft/s.

There is currently no USGA limit on the COR of a golf ball, but the initial velocity of the golf ball cannot exceed 250±5 feet/second (ft/s). Thus, in one embodiment, the initial velocity is about 245 ft/s or greater and about 255 ft/s or less. In another embodiment, the initial velocity is about 250 ft/s or greater. In one embodiment, the initial velocity is about 253 ft/s to about 254 ft/s. In yet another embodiment, the initial velocity is about 255 ft/s. While the current rules on initial velocity require that golf ball manufacturers stay within the limit, one of ordinary skill in the art would appreciate that the golf ball of the invention would readily convert into a golf ball with initial velocity outside of this range.

As a result, of the initial velocity limitation set forth by the USGA, the goal is to maximize COR without violating the 255 ft/s limit. In a one-piece solid golf ball, the COR will depend on a variety of characteristics of the ball, including its composition and hardness. For a given composition, COR will generally increase as hardness is increased. In a two-piece solid golf ball, e.g., a core and a cover, one of the purposes of the cover is to produce a gain in COR over that of the core. When the contribution of the core to high COR is substantial, a lesser contribution is required from the cover. Similarly, when the cover contributes substantially to high COR of the ball, a lesser contribution is needed from the core.

The present invention contemplates golf balls having CORs from about 0.7 to about 0.85. In one embodiment, the COR is about 0.75 or greater, preferably about 0.78 or greater. In another embodiment, the ball has a COR of about 0.8 or greater.

In addition, the inner ball preferably has a COR of about 0.780 or more. In one embodiment, the COR is about 0.790 or greater.

Ball Spin

As known to those of ordinary skill in the art, the spin rate of a golf ball will vary depending on the golf ball construction. In a multilayer ball, e.g., a core, an intermediate layer, and a cover, wherein the cover is formed from the polyurea or polyurethane compositions of the invention, the spin rate of the ball off a driver ("driver spin rate") is preferably about 2700 rpm or greater. In one embodiment, the driver spin rate is about 2800 rpm to about 3500 rpm. In another embodiment, the driver spin rate is about 2900 rpm to about 3400 rpm. In still another embodiment, the driver spin rate may be less than about 2700 rpm.

Two-piece balls made according to the invention may also have driver spin rates of 2700 rpm and greater. In one embodiment, the driver spin rate is about 2700 rpm to about 3300 rpm. Wound balls made according to the invention may have similar spin rates.

Methods of determining the spin rate should be well understood by those of ordinary skill in the art. Examples of methods for determining the spin rate are disclosed in U.S. Pat. Nos. 6,500,073, 6,488,591, 6,286,364, and 6,241,622, which are incorporated by reference herein in their entirety.

Flexural Modulus

Accordingly, it is preferable that the golf balls of the present invention have an intermediate layer with a flexural modulus of about 500 psi to about 500,000 psi. More preferably, the flexural modulus of the intermediate layer is about 1,000 psi to about 250,000 psi. Most preferably, the flexural modulus of the intermediate layer is about 2,000 psi to about 200,000 psi.

The flexural moduli of the cover layer is preferably about 2,000 psi or greater, and more preferably about 5,000 psi or greater. In one embodiment, the flexural modulus of the cover is from about 10,000 psi to about 150,000 psi. More preferably, the flexural modulus of the cover layer is about 15,000 psi to about 120,000 psi. Most preferably, the flexural modulus of the cover layer is about 18,000 psi to about 110,000 psi. In another embodiment, the flexural moduli of the cover layer is about 100,000 psi or less, preferably about 80,000 or less, and more preferably about 70,000 psi or less. In one embodiment, when the cover layer has a hardness of about 50 Shore D to about 60 Shore D, the cover layer preferably has a flexural modulus of about 55,000 psi to about 65,000 psi.

In one embodiment, the ratio of the flexural modulus of the intermediate layer to the cover layer is about 0.003 to about 50. In another embodiment, the ratio of the flexural modulus of the intermediate layer to the cover layer is about 0.006 to about 4.5. In yet another embodiment, the ratio of the flexural modulus of the intermediate layer to the cover layer is about 0.11 to about 4.5.

As briefly discussed above, the compositions of the invention are used in a golf ball with multiple cover layers having essentially the same hardness, but differences in flexural moduli. In this aspect of the invention, the difference between the flexural moduli of the two cover layers is preferably about 5,000 psi or less. In another embodiment, the difference in flexural moduli is about 500 psi or greater. In yet another embodiment, the difference in the flexural moduli between the two cover layers, wherein at least one is reinforced is about 500 psi to about 10,000 psi, preferably from about 500 psi to about 5,000 psi. In one embodiment, the difference in flexural moduli between the two cover layers formed of unreinforced or unmodified materials is about 1,000 psi to about 2,500 psi.

Specific Gravity

The specific gravity of a cover or intermediate layer including the polyurethane or polyurea compositions of the invention is preferably at least about 0.7.

While it is apparent that the invention disclosed herein is well calculated to fulfill the objects stated above, it will be appreciated that numerous modifications and embodiments may be devised by those skilled in the art. For example, while golf balls and golf ball components are used as examples for articles incorporating the compositions of the invention, other golf equipment may be formed from the compositions of the invention. In one embodiment, at least a portion of a golf shoe is formed from the composition of the invention. In another embodiment, the composition of the invention is used to form at least a portion of a golf club, e.g., a putter insert. Therefore, it is intended that the appended claims cover all such modifications and embodiments that fall within the true spirit and scope of the present invention.

We claim:

1. A golf ball comprising a core, an intermediate layer, and a cover, wherein the core has a hardness of 30 Shore D or greater, the intermediate layer has a first hardness, and the cover has a second hardness, wherein the ratio of the second hardness to first hardness is 0.7 or less, and wherein the cover is formed from a highly neutralized polymer composition comprising:

a reactive processing moiety comprising oxa acid, an oxa salt, an oxa ester, or combination thereof;

a thermoplastic resin component having an acid functionalized moiety comprising at least one acid group, ionic group, or combination thereof; and a neutralizing component, wherein greater than about 70 percent of the acid functionalized moiety is neutralized.

2. The golf ball of claim 1, wherein at least about 90 percent or greater of the acid functionalized moiety is neutralized.

3. The golf ball of claim 1, wherein the neutralizing component comprises an inorganic metal compound, an organic amine, or a combination thereof.

4. The golf ball of claim 3, wherein the neutralizing component comprises magnesium oxide, magnesium hydroxide, magnesium carbonate, zinc oxide, zinc acetate, sodium hydroxide, sodium carbonate, calcium oxide, calcium hydroxide, lithium oxide, lithium hydroxide, or mixtures thereof.

5. The golf ball of claim 1, wherein the reactive processing moiety is present in an amount of about 0.1 percent to about 50 percent by weight of the composition, wherein the thermoplastic resin component is present in an amount of about 50 percent to about 99 percent by weight of the composition, and wherein the neutralizing component is present in an amount of about 0.5 percent to about 10 percent by weight of the composition.

6. The golf ball of claim 1, wherein the reactive processing moiety has the general formula:

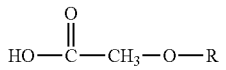

wherein R is an organic moiety selected from the group consisting of moieties having the formula $—[CH_2—CH_2—O]_n—R'$ and alkyl, carbocyclic, and heterocyclic groups, wherein R' is an organic moiety selected from the group consisting of alkyl, carbocyclic, carboxylic acid, heterocyclic groups, and mixtures thereof, and wherein n is at least 1.

7. The golf ball of claim 1, wherein the reactive processing moiety comprises 3,6-dioxaheptanoic acid, 7,7-dimethyl-3,6-dioxaheptanoic acid, 3,6-dioxaheptanoic acid ethyl ester, 3,6-dioxaheptanoic acid dodecyl ester, 2-phenyl-3,6-dioxaheptanoic acid, 2-benzyl-3,6-dioxaheptanoic acid, 2-methyl-3,6-dioxaheptanoic acid, 3,6,9-trioxadecanoic acid, 3,6,9-trioxaheptanoic acid, 2-phenyl-3,6,9-trioxaheptanoic acid, 2-benzyl-3,6,9-trioxaheptanoic acid, 2-decyl-3,6,9-trioxaheptanoic acid, 3,6,9-trioxaundecanedioic acid, 3,6,9,12-tetraoxatridecanoic acid, 3,6,9,12,15-pentaoxahexadecanoic acid, 2-methyl-3,6,9-trioxadecanoic acid, 10,10-dimethyl-3,6,9-trioxadecanoic acid, 2-ethyl-3,6,9,12-tetraoxatridecanoic acid, 10-phenyl-3,6,9-trioxadecanoic acid, 3,6,9-trioxadecanoic acid ethyl ester, 10,10-dimethyl-3,6,9-trioxadecanoic acid ethyl ester, 10,10-dimethyl-3,6,9-trioxadecanoic acid heptadecanyl ester, polyglycol diacid, and mixtures thereof.

8. The golf ball of claim 1, wherein the oxa acid has an acid number of about 50 mg KOH/g or greater.

9. The golf ball of claim 1, wherein the oxa acid has a viscosity of about 35 mPAS or greater at 20° C.

10. The golf ball of claim 1, wherein the highly neutralized polymer composition has a melt flow index of about 0.5 grams per 10 minutes at 190° C. and a 2,100 gram load.

11. The golf ball of claim 1, wherein the thermoplastic resin component comprises at least one of an olefin-unsaturated carboxylic acid random copolymer, an olefin-unsaturated carboxylic acid-unsaturated carboxylate ternary copolymer, an olefin-unsaturated carboxylic acid-unsaturated carboxylate ternary copolymer at least partially neutralized with a metal ion, or mixtures thereof.

12. The golf ball of claim 1, wherein the thermoplastic resin component comprises at least one of a polyolefin, olefin elastomer, urethane elastomer, polyester elastomer, styrene elastomer blended with a polyamide elastomer, polyurea elastomer, polyamide, polycarbonate, polyimide, polyacrylate, polysilicone, or mixtures thereof.

13. A golf ball comprising:

a core having a hardness of about 30 Shore D or greater;

an intermediate layer having a first hardness;

a cover having a second hardness of about 50 Shore D or greater, wherein the ratio of the second hardness to the first hardness is 0.7 or less, and wherein the cover is formed of a highly neutralized polymer composition comprising:

a reactive processing moiety comprising an oxa acid, an oxa salt, an oxa ester, or a combination thereof;

a thermoplastic resin component comprising at least one acid group, ionic group, or combination thereof; and a neutralizing component.

14. The golf ball of claim 13, wherein the reactive processing moiety is selected from the group consisting of comprises 3,6-dioxaheptanoic acid, 7,7-dimethyl-3,6-dioxaheptanoic acid, 3,6-dioxaheptanoic acid ethyl ester, 3,6-dioxaheptanoic acid dodecyl ester, 2-phenyl-3,6-dioxaheptanoic acid, 2-benzyl-3,6-dioxaheptanoic acid, 2-methyl-3,6-dioxaheptanoic acid, 3,6,9-trioxadecanoic acid, 3,6,9-trioxaheptanoic acid, 2-phenyl-3,6,9-trioxaheptanoic acid, 2-benzyl-3,6,9-trioxaheptanoic acid, 2-decyl-3,6,9-trioxaheptanoic acid, 3,6,9-trioxaundecanedioic acid, 3,6,9,12-tetraoxatridecanoic acid, 3,6,9,12,15-pentaoxahexadecanoic acid, 2-methyl-3,6,9-trioxadecanoic acid, 10,10-dimethyl-3,6,9-trioxadecanoic acid, 2-ethyl-3,6,9,12-tetraoxatridecanoic acid, 10-phenyl-3,6,9-trioxadecanoic acid, 3,6,9-trioxadecanoic acid ethyl ester, 10,10-dimethyl-3,6,9-trioxadecanoic acid ethyl ester, 10,10-dimethyl-3,6,9-trioxadecanoic acid heptadecanyl ester, polyglycol diacid, and mixtures thereof.

15. The golf ball of claim 13, wherein the core has a diameter of about 1.55 inches or greater.

16. The golf ball of claim 13, wherein the cover has a thickness of about 0.02 inches to about 0.07 inches.

17. A golf ball comprising:

a core having a hardness of about 30 Shore D or greater;

at least one intermediate layer having a first hardness;

a cover having a second hardness, wherein the ratio of the second hardness to the first hardness is about 0.7 or less, and wherein the cover is formed of a highly neutralized polymer composition comprising:

a reactive processing moiety comprising an oxa acid, an oxa salt, an oxa ester, or a combination thereof;

a thermoplastic resin component comprising at least one acid group, ionic group, or combination thereof; and a neutralizing component.

18. The golf ball of claim 17, wherein the ratio of the second hardness to the first hardness is about 0.45 or less.

19. The golf ball of claim 17, wherein the reactive processing moiety is present in an amount of about 10 percent to about 30 percent by weight of the highly neutralized polymer composition, wherein the thermoplastic resin component is present in an amount of about 70 percent to about 90 percent by weight of the highly neutralized polymer composition, and wherein the neutralizing component is present in an amount of about 2 percent to about 6 percent by weight of the highly neutralized polymer composition.

20. The golf ball of claim 17, wherein the thermoplastic resin component comprises at least one of a polyolefin, olefin elastomer, urethane elastomer, polyester elastomer, styrene elastomer blended with a polyamide elastomer, polyurea elastomer, polyamide, polycarbonate, polyimide, polyacrylate, polysilicone, or mixtures thereof.

21. The golf ball of claim 17, wherein the neutralizing component comprises magnesium oxide, magnesium hydroxide, magnesium carbonate, zinc oxide, zinc acetate, sodium hydroxide, sodium carbonate, calcium oxide, calcium hydroxide, lithium oxide, lithium hydroxide, or mixtures thereof.

22. The golf ball of claim 17, wherein the core comprises a center and an outer core layer.

23. The golf ball of claim 17, wherein the highly neutralized polymer composition further comprises at least one density-adjusting filler.

* * * * *